US007690434B2

(12) United States Patent
Baross et al.

(10) Patent No.: US 7,690,434 B2
(45) Date of Patent: Apr. 6, 2010

(54) OFFSHORE VESSEL MOORING AND RISER INBOARDING SYSTEM

(75) Inventors: John Stephen Baross, Aberdeenshire (GB); Robin Stuart Colquhoun, Sharjah (AE)

(73) Assignee: Stanwell Consulting Limited (GB)

( * ) Notice: Subject to any disclaimer, the term of this patent is extended or adjusted under 35 U.S.C. 154(b) by 410 days.

(21) Appl. No.: 11/574,809

(22) PCT Filed: Sep. 30, 2005

(86) PCT No.: PCT/GB2005/003766

§ 371 (c)(1),
(2), (4) Date: Apr. 27, 2007

(87) PCT Pub. No.: WO2006/037964

PCT Pub. Date: Apr. 13, 2006

(65) Prior Publication Data

US 2008/0277123 A1 Nov. 13, 2008

(30) Foreign Application Priority Data

Oct. 1, 2004 (GB) ..... 0421795.6

(51) Int. Cl.
*E21B 43/01* (2006.01)

(52) U.S. Cl. ..... 166/354; 166/352; 166/367; 441/5; 114/230.12; 114/230.13

(58) Field of Classification Search ..... 166/354, 166/352, 367; 114/230.1, 230.13, 293, 264, 114/230.12; 441/3–6; 405/224, 224.2–224.4
See application file for complete search history.

(56) References Cited

U.S. PATENT DOCUMENTS 3,523,578 A * 8/1970 Crain et al. ..... 166/359

(Continued)

FOREIGN PATENT DOCUMENTS

EP 0167226 1/1986

(Continued)

OTHER PUBLICATIONS

Mace, et al; Disconnectable Riser Turret Mooring System for Jabiru's Tanker-Based Floating Production System; Paper presented at 19th Annual Offshore Technology Conference, Houston, Texas Apr. 27-30, 1987.

(Continued)

*Primary Examiner*—Thomas A Beach
*Assistant Examiner*—Matthew R Buck
(74) *Attorney, Agent, or Firm*—Daniel N. Lundeen; Lundeen & Lundeen, PLLC

(57) ABSTRACT

There is disclosed an offshore vessel mooring and riser inboarding system (12) for a vessel (10) such as an FPSO or FSO. In one embodiment, the system comprises a first mooring element (16) adapted to be located in an offshore environment (18); a riser (20) adapted to be coupled to the first mooring element; a connector assembly (22) 11 adapted to be mounted on the vessel, the connector assembly comprising a second mooring element (28); and a transfer line (32) adapted to be coupled to the riser; wherein the first and second mooring elements are adapted to be connected to facilitate coupling of the riser and the transfer line; and wherein the connector assembly is adapted to permit relative rotation between the vessel and the first mooring element about three mutually perpendicular axes of rotation. This facilitates weathervaning of the vessel relative to the first mooring element, as well as pitch, roll, heave and surge, under applied wind, wave and/or tidal forces.

52 Claims, 17 Drawing Sheets

U.S. PATENT DOCUMENTS

| | | | | | |
|---|---|---|---|---|---|
| 3,602,175 | A | | 8/1971 | Morgan | |
| 4,010,500 | A | * | 3/1977 | Reid, Jr. | 441/5 |
| 4,029,039 | A | | 6/1977 | van Heijst | |
| 4,088,089 | A | * | 5/1978 | Flory | 114/230.14 |
| 4,226,204 | A | | 10/1980 | Tuson | |
| 4,262,380 | A | * | 4/1981 | Foolen | 441/3 |
| 4,290,158 | A | * | 9/1981 | Kuntz, Jr. | 441/3 |
| 4,299,262 | A | * | 11/1981 | Andrepont | 141/387 |
| 4,490,121 | A | * | 12/1984 | Coppens et al. | 441/5 |
| 4,602,586 | A | * | 7/1986 | Ortloff | 114/230.15 |
| 4,727,819 | A | * | 3/1988 | Pollack | 114/230.12 |
| 4,741,716 | A | * | 5/1988 | Hasebe et al. | 441/4 |
| 4,836,813 | A | * | 6/1989 | Poldervaart | 441/3 |
| 4,876,978 | A | * | 10/1989 | O'Nion et al. | 114/230.15 |
| 5,041,038 | A | * | 8/1991 | Poldervaart et al. | 441/5 |
| 5,044,297 | A | * | 9/1991 | de Baan et al. | 114/293 |
| 5,509,838 | A | * | 4/1996 | Breivik et al. | 441/5 |
| 5,755,607 | A | * | 5/1998 | Boatman et al. | 441/5 |
| 5,794,700 | A | | 8/1998 | Pollack | |
| 6,200,180 | B1 | * | 3/2001 | Hooper | 441/5 |
| 6,406,222 | B1 | | 6/2002 | Pollack | |
| 6,431,101 | B1 | | 8/2002 | Lunde et al. | |
| 6,435,124 | B1 | | 8/2002 | Williams | |
| 6,938,571 | B1 | | 9/2005 | Pollack | |
| 7,029,348 | B2 | * | 4/2006 | Bauduin et al. | 441/4 |
| 2006/0180231 | A1 | * | 8/2006 | Harland et al. | 141/1 |
| 2006/0231155 | A1 | * | 10/2006 | Harland et al. | 141/11 |

FOREIGN PATENT DOCUMENTS

| | | |
|---|---|---|
| EP | 0597595 | 5/1994 |
| EP | 0796784 | 9/1997 |
| GB | 1165520 | 10/1969 |
| GB | 2204291 | 11/1988 |
| GB | 2296904 | 7/1996 |
| WO | 93/24732 | 12/1993 |
| WO | 93/24733 | 12/1993 |
| WO | 03049994 | 6/2003 |
| WO | 03062043 | 7/2003 |
| WO | 2005/045302 | 5/2005 |
| WO | 2006/089042 | 8/2006 |

OTHER PUBLICATIONS

Novel turret design speeds Libyan vessel construction; Offshore Engineer, oilonline.com; Sep. 2002.

* cited by examiner

OFFSHORE VESSEL MOORING AND RISER INBOARDING SYSTEM

The present invention relates to an offshore vessel mooring and riser inboarding system, and to a method of mooring a vessel in an offshore environment. In particular, but not exclusively, the present invention relates to an offshore mooring and riser inboarding system for a vessel such as a Floating Production Storage and Offloading Vessel (FPSO) or a Floating Storage and Offloading Vessel (FSO), and to a method of mooring a vessel in an offshore environment.

In the oil and gas exploration and production industry, well fluids (oil and gas) from offshore oil wells can be transported to shore by submarine pipelines, laid on the seabed. However, installing submarine pipelines involves the use of dedicated pipelaying vessels, with a very large associated capital expenditure, and the use of such pipelines is therefore only commercially viable in limited circumstances. As a result, the exploitation of oil and gas fields in certain areas, particularly those far offshore or in deep water locations, has been shown in the past to be of such marginal value that it has not been worth extracting the available oil and gas reserves.

To address this problem, there have been movements in the industry towards the exploitation of offshore oil and gas fields by the use of FPSOs or FSOs. An FPSO is moored in an offshore location and is typically coupled to a number of producing wells, for the temporary storage of produced well fluids, which are periodically exported to shore by tankers. FPSOs typically include facilities for separating recovered well fluids into different constituents (oil, gas and water), so as to stabilise the crude oil for onward transport by tanker. FSOs are similarly moored and allow for the storage of recovered well fluids, and may either be disconnected from their moorings for travel to an offloading location, or the recovered fluids may similarly be exported by tanker. In contrast to FPSOs, however, FSOs do not have the facility for separating the well fluids into different constituents, and are therefore used in more limited circumstances, typically for storage of stabilised, low pressure crude.

Whilst some vessels are constructed and designed for these purposes, many FPSOs and FSOs are conversions of existing trading tankers Converted vessels of this type have usually functioned adequately, but there is a continuing need for a substantial reduction in costs in order to improve the economics of prospective development and production of oil and gas fields, particularly those which are currently deemed to be marginal.

Tankers used hitherto have often required extensive conversion work to enable them to operate as an FPSO or FSO. The extent of conversion work required depends upon factors including the particular circumstances under which the vessel is to be moored offshore.

A number of different systems have been developed for mooring vessels such as FPSOs and FSOs. For example, in one system, flowlines extend from the seabed to a mooring assembly which includes a buoyant mooring node, which is located just below the sea surface. The node is moored to the seabed by a number of mooring chains, and the flowlines extend from the seabed to the node. A vessel such as an FPSO is coupled to the node by a chafe chain anchored on the vessel forecastle, and the chafe chain and the flowlines extend over a ramp on to the bow of the vessel. Whilst the FPSO can weathervane around the sea surface in the prevailing wind/tide, the degree of movement permitted is limited (by the chafe chain and the flowlines) to around one-and-a half rotations of the vessel relative to the node in either rotational direction; the vessel must then be either disconnected and reset with the chain and flowlines in their original positions, or rotated back to its median heading with the aid of another vessel. Additional problems include that the bow must be strengthened to accommodate loads imparted by the chains and the flowlines, and that the chain and the flowlines wear over time due to scrubbing/chafing movement on the bow of the vessel.

In an alternative system, a buoyant canister is located with a part above and a part below the sea surface. The canister is moored to the seabed by a number of mooring chains, which are connected to the canister, and the canister is connected to a vessel such as an FPSO by a cantilever frame on the FPSO. The frame is coupled to the canister by a swivel, to permit weathervaning of the vessel in the wind/tide, but is not free about the two orthogonal axes. In use, the canister requires to be maintained in a vertical orientation, to maintain connection with the frame and to permit weathervaning. Wind, wave and tidal loads on the FPSO are transmitted to the canister through the frame, and can be extremely large. For example, in the event of a storm surge force acting on the vessel tending to move the vessel astern, a large bending moment is generated at the canister head. This is due to the distance between the location at which the mooring chains are connected to the canister and the location where the connecting frame is coupled to the canister; this distance is dictated by a requirement to ensure that the FPSO does not strike the mooring lines. As a result, the connecting frame experiences large forces and is therefore a relatively heavy, bulky structure, adding to the complexity of a tanker conversion for use as an FPSO, and to the overall weight of the structure at the vessel bow. The canister likewise has to be robust and heavy to sustain the large bending moment.

Further systems involve the introduction of a rotating turret into the hull of a vessel, which permits engagement with a subsea buoy initially located below surface. Installation of systems of this type involves deep invasion into the structure of the vessel, necessitating a substantial period in drydock. Such systems are therefore relatively time-consuming and costly to install. Furthermore, it is harder to achieve connection of the vessel to systems of this type, as the buoy must be below surface during approach of the vessel on station above it.

All of the systems developed to date have therefore suffered from a number of disadvantages, including: that they do not allow the vessel to weathervane continuously without restriction; that they have been difficult to install and hook up in the field; that they have had an uncertain ability to allow the vessel to disconnect rapidly, reliably and safely from the risers; and that they have had a relatively restricted seastate capability. Systems employing a chafe chain coupled to a subsea node have also been prone to the risk of local combined tension-bending fatigue in the upper mooring chain where it traverses a ramp or fairlead on its route to a forecastle deck anchorage.

These problems apply in relation to the bringing inboard of flow risers or lines (conduits for hydrocarbons or other fluids), as well as to other risers or lines such as power/control cables (for example, electrical lines and hydraulic lines), and umbilicals.

It is amongst the objects of embodiments of the present. invention to obviate or mitigate at least one of the foregoing disadvantages.

According to a first aspect of the present invention, there is provided an offshore vessel mooring and riser inboarding system, the system comprising:

a first mooring element adapted to be located in an offshore environment;

a riser adapted to be coupled to the first mooring element;

a connector assembly adapted to be mounted on a vessel, the connector assembly comprising a second mooring element; and a transfer line adapted to be coupled to the riser;

wherein the first and second mooring elements are adapted to be connected to facilitate coupling of the riser and the transfer line;

and wherein the connector assembly is adapted to permit relative rotation between the vessel and the first mooring element about three mutually perpendicular axes of rotation.

By permitting such relative rotation between the vessel and the first mooring element, the present invention facilitates movement of the vessel under external loading, in use, and reduces forces transmitted to/borne by the vessel and the mooring and riser system components. Accordingly, the connector assembly of the present invention may not be required to support the relatively large loads found in prior art systems. In addition, the system permits all likely ranges of movement of the vessel relative to the first mooring element without excessive wear or damage to components either of the system or to the vessel itself. In particular, the vessel is able to weathervane (that is, to move in response to applied wind, wave and/or tidal loads, to face a direction of the prevailing wind, waves and/or tide), and to heave, pitch, roll, surge, sway and yaw.

It will be understood that the three mutually perpendicular axes of rotation may be taken about or with reference to the first mooring element and may be taken when the vessel is in a neutral or unloaded position. Thus the first mooring element has three degrees of freedom in its movement.

The riser may comprise or may take the form of a fluid flow riser or flowline, which may be a conduit for hydrocarbon containing fluids or other fluids. Alternatively, the riser may comprise or may take the form of a power and/or control cable, such as an electrical and/or hydraulic cable. The riser may be an umbilical comprising a flowline and one or more power and/or control cable. The system may therefore permit inboarding of any desired type of riser on to a vessel. References herein to inboarding of a riser and to a riser inboarding system are to the bringing inboard or onboard of a riser to a vessel and to such a system.

Where the riser comprises or takes the form of a fluid flow riser or flowline, the transfer line may be a transfer flowline, and connection of the first and second mooring elements may facilitate flow of fluid between the fluid flow riser, the transfer flowline and the vessel. The transfer flowline may be for the passage of fluid from the fluid flow riser into the transfer flowline and to the vessel, or vice-versa.

Where the riser comprises or takes the form of a power and/or control cable, the transfer line may provide an electrical and/or hydraulic and/or other connection to the riser. This may facilitate power supply, data transmission and/or supply of hydraulic control fluid.

Preferably, the connector assembly further comprises a support adapted to be mounted on the vessel, and the second mooring element may be adapted to be mounted for movement relative to the support. The support may be a cantilever support and may be a support frame or the like. The support may be located extending beyond a bow or stern of the vessel, or from the side of the vessel. This may provide clearance for alignment and connection of the first and second mooring elements.

Preferably also, the connector assembly further comprises an outer gimbal member, which may be mounted for rotation relative to a part of the connector assembly, in particular, the support. The assembly may also comprise an inner gimbal member mounted for rotation relative to the outer gimbal member. Additionally, the assembly may comprise a rotatable coupling for facilitating rotation of the inner gimbal member relative to the first mooring element. The rotatable coupling, inner gimbal member and outer gimbal member together permit relative rotation between the vessel and the first mooring element about said axes of rotation.

The inner gimbal member may be rotatable about an inner gimbal axis and the outer gimbal member about an outer gimbal axis. The inner and outer gimbal member axes may be disposed substantially perpendicular to one another. This may facilitate relative rotation between the vessel and the first mooring element about two of the three mutually perpendicular axes of rotation.

The rotatable coupling may facilitate rotation between the inner gimbal member and the second mooring element, to thereby permit relative rotation between the vessel and the first mooring element about one of the three axes of rotation. The rotatable coupling may therefore be provided between the inner gimbal member and the second mooring element. Alternatively, the rotatable coupling may facilitate rotation between the second mooring element and the first mooring element, to permit such rotation. The rotatable coupling may thus be provided between the first and second mooring elements and may be coupled to one of said elements. The rotatable coupling may be a swivel and may comprise a rotary bearing, such as a needle or roller bearing or a journal bearing of special marine bearing material.

The inner and outer gimbal members may be annular rings and the inner gimbal ring may be located within the outer gimbal ring. In preferred embodiments, where the connector assembly comprises a support adapted to be mounted on the vessel, the outer gimbal member may be rotatably mounted to the support and the inner gimbal member may be rotatably mounted to the outer gimbal member. Where the inner and outer gimbal members comprise annular rings, the inner gimbal ring may be mounted to the outer gimbal ring by inner trunnions and the outer gimbal ring may be mounted to the support by outer trunnions, the trunnions of the inner gimbal ring disposed perpendicular to those of the outer gimbal ring.

The connector assembly, in particular the support (which may be a cantilever structure), may be releasably mountable on the vessel. This may facilitate removal of the connector assembly if required. This may be desired, for example, where the connector assembly is provided on a vessel such as a tanker converted for use as an FPSO or FSO and it is desired to convert the vessel back for use as a standard tanker.

Preferably, the first mooring element is buoyant and may comprise or define a buoyant member. Alternatively, the system may comprise a separate buoyant member, and the first mounting element may be coupled indirectly to the buoyant member by a chain or the like. The first mooring element or the buoyant member may be generally tubular, and may optionally be a cylindrical tubular, and may define an internal passage for receiving the main riser. This may serve both to guide the riser into engagement with the first mooring element, and may also protect the riser from damage, for example, by contact with the vessel in storm conditions.

The first mooring element and/or the buoyant member may be adapted to be located at surface prior to connection of the first and second mooring elements together. Accordingly, at least part of the first mooring element may protrude above a sea surface level. Alternatively, the entire first mooring element may be adapted to be located below sea surface level. This may protect the first mooring element and the riser from loading, such as wind and wave loading. In this situation, the location of the first mooring element/buoyant member may be indicated by a marker buoy or the like.

The first mooring element may be adapted to be moored to or relative to a seabed in the offshore environment by a plurality of mooring lines. The mooring lines may be catenary chains, mooring cables of wire or polymer rope or other material, or a combination thereof. The mooring lines may be adapted to bear loading of the vessel on the first mooring element, to maintain the element on station and/or to prevent or minimise transmission of loads to the riser. The mooring lines may be coupled to or adjacent to a lower end or portion of the first mooring element. This may provide sufficient clearance between the mooring lines and the hull of the vessel, in use, when the first and second mooring elements are connected.

In embodiments of the invention, the system may be a mooring and riser inboarding system for a dynamically positionable vessel. As is known in the industry, dynamically positioned (DP) vessels are capable of maintaining their geographical position through a control system which includes a number of thrusters spaced around the hull of the vessel. Where the system is designed for use with such a vessel, it may not be necessary to moor the first mooring element to or relative to the seabed, as the mooring element does not require to maintain the vessel on station. In these circumstances, the riser may bear the relatively minor loading experienced by the first mooring element due to, for example, wind, wave and tidal forces.

The first and second mooring elements may comprise or may define first and second connector elements, respectively, and may be adapted to be coupled together in a quick-connect and disconnect arrangement. This may facilitate alignment, connection and disconnection of the first and second connector elements, in use. One of the first and second mooring elements may comprise a male member and the other a female member, the female member adapted to receive the male member for engagement of the elements. The connector assembly may comprise a locking arrangement for locking the first and second mooring elements together. The locking arrangement may comprise at least one latch, locking dog or pin, which may be adapted to provide a releasable locking engagement between the first and second mooring elements.

The connector assembly may comprise an intermediate connector for coupling the first and second mooring elements together. The intermediate connector may be secured to the first mooring element and thus may be provided as part of the first mooring element, and may be adapted to be releasably coupled to the second mooring element. However, the intermediate connector may also be releasably connected to the first mooring element. The intermediate connector may also be adapted to support the riser, and may define a riser hang-off unit. Releasably securing the riser hang-off unit to the first mooring element may facilitate access to the risers for maintenance. The connector assembly may comprise a jacking assembly or device, for selectively separating the first and second mooring elements by a desired or suitable distance.

Preferably, the system comprises a plurality of risers and a corresponding plurality of transfer lines. Each transfer line may be associated with a corresponding riser. Alternatively, a single transfer line may be associated with a plurality of risers. Where the riser is a fluid flow riser, each riser may be coupled to or associated with a separate well, for the flow of well fluids comprising oil and/or gas to the vessel.

The/each transfer line may be coupled to the/each respective riser through a rotatable line coupling such as a swivel or the like, which may be provided as part of or coupled to the second mooring element. This may facilitate weathervaning of the vessel whilst maintaining connection between the riser and the transfer line.

Preferably, the connector assembly permits unlimited rotation between the vessel and the first mooring element about one of said axes of rotation, which may be a vertical or Y-axis. This may facilitate full weathervaning of the vessel around the first mooring element. Rotation between the vessel and the first mooring element about the other two of said axes of rotation may be restricted depending upon dimensions of the connector assembly, and in particular, by dimensions of the inner and outer gimbal member. However, rotation of at least up to 60 degrees from a neutral position about the other two of said axes may be permitted, providing up to 120 degrees total permissible rotation.

The system may comprise a device for adjusting a position or orientation of the second mooring element relative to the first mooring element, to facilitate connection of the first and second mooring elements. In particular, where the connector assembly comprises a rotatable coupling and inner and outer gimbal members, the system may comprise a device for adjusting a rotational position of the outer gimbal member relative to the support; and/or of the inner gimbal member relative to the outer gimbal member; and/or a rotational orientation of the first and second mooring elements.

The present invention may facilitate flow of well fluids from a riser in the form of a fluid flowline through a transfer flowline to a vessel. Additionally or alternatively, the invention may be utilised in circumstances where it is desired to offload fluid from the vessel through the transfer flowline and into the main flowline. This may facilitate discharge of fluid carried by the vessel into a well, such as in order to stimulate production, and/or to supply well fluids from the vessel into a storage or transfer system, for subsequent transfer to an alternative location. References herein to transfer of fluid between the main flowline, the transfer flowline and the vessel should therefore be interpreted accordingly.

According to a second aspect of the present invention, there is provided a method of mooring a vessel in an offshore environment, the method comprising the steps of:

locating a first mooring element in an offshore environment;

coupling a riser to the first mooring element;

connecting a second mooring element of a connector assembly mounted on a vessel to the first mooring element, such that relative rotation between the vessel and the first mooring element about three mutually perpendicular axes of rotation is permitted;

coupling a transfer line between the vessel and the second mooring element; and connecting the transfer line to the riser.

The method may comprise coupling a fluid flow riser to the first mooring element, and coupling a transfer flowline to the second mooring element. Following connection of the transfer flowline to the fluid flow riser, the method may comprise transferring fluid between the fluid flow riser, the transfer flowline and the vessel.

Further features of the method are defined above in relation to the first aspect of the invention.

According to a third aspect of the present invention, there is provided an offshore vessel mooring and riser inboarding system, the system comprising:

a first mooring element adapted to be located in an offshore environment;

at least one riser adapted to be coupled to the first mooring element;

a support adapted to be mounted on a vessel;

an outer gimbal member mounted for rotation relative to the support;

an inner gimbal member mounted for rotation relative to the outer gimbal member;

a second mooring element adapted for connection to the first mooring element;

a rotatable coupling for facilitating rotation of the inner gimbal member relative to the first mooring element; and at least one transfer line adapted to be coupled between the vessel and the second mooring element;

wherein, in use, the first and second mooring elements are adapted to be connected to couple the transfer line to the riser;

and wherein the rotatable coupling, the inner gimbal member and the outer gimbal member together permit rotation of the vessel relative to the first mooring element.

There may be three degrees of freedom in movement of the vessel relative to the first mooring element provided by the inner and outer gimbal members and the rotatable coupling.

According to a fourth aspect of the present invention, there is provided a freely weathervaning bow or stern or side mooring and riser inboarding system comprising:

means for mooring an offtake tanker or buffer tanker or FPSO to the seabed and one or more fluid flowline and/or. well control umbilical or electrical umbilical risers connecting seabed facilities to the tanker or FPSO;

the mooring system comprising at least three chain or rope or hybrid mooring lines with or without anchors, each line being attached to padeyes at the lower end of a cylindrical annular flotation canister, the upper end of which is latched into a specially designed mooring swivel suspended within a gimbal in a structural cantilever projecting forward from the bow of the vessel at focsle deck level or at the stern or other position off the vessel's gunwale and being additionally supported by structural members springing from the vessel hull typically at focsle deck level or below;

the gimbal being so designed as to be capable of accommodating an angular deviation of the flotation canister axis relative to the intersection of the sagittal and transom planes of the ship of plus or minus 60 degrees in any direction arising as a result of the first and second order motions of the ship subject only to the constraint of avoidance of interference with the bulbous bow;

each fluid flowline and umbilical running from the direction of the seabed well or subsea facility and ascending as a riser in the configuration of a Lazy Wave or other suitable shape and entering the lower end of the annular flotation canister through polymer bend-stiffeners attached to the lower end of the canister and projecting below the canister and each flowline and umbilical then ascending through the canister and through the mooring swivel and gimbal to a hangoff frame above and thence upwards via double-valved quick disconnects to a multiple path swivel stack with its inner (geodetically fixed azimuth) part standing on the upper part of the quick disconnect assembly and riser hangoff unit within the inner ring of the special mooring swivel and the outer part of the multiple path swivel stack following the azimuth of the vessel (the swivel stack may consist of one single path swivel alone in applications where there is only one fluid conduit riser and no umbilical);

the fluid and electrical conduits from the outer part of the swivel stack passing down between the middle and inner gimbal rings in the form of catenary jumpers terminating at the vessel's pipework and cabling at a hangoff location on the stem of the vessel typically between main deck and focsle deck level whence the fluid conduits proceed to Emergency Shutdown Valves (ESDs) and a manifold inboard;

the multiple path swivel stack being shielded from the weather within a protective housing mounted on the outer ring of the mooring swivel so as to enable servicing and maintenance work on the stack to be performed conveniently and safely;

the riser hangoff frame being an integral part of a specially designed Riser Hangoff Unit (RHU) incorporating at its upper end the lower part of the multiple path fluid conduit and electrical conduit quick disconnect assembly (QDC) including the lower valve set and incorporating at its lower end a specially designed Latching Can (LC) containing the two sets of latches which respectively lock the RHU into the flotation canister and lock the whole of the RHU-cum-flotation-canister assembly into the inner ring of the mooring swivel;

the RHU being capable of being broken (unbolted) just above the LC and the upper part of it together with QDC and swivel stack being jacked up so as to provide access above the LC for work in connection with initial pull-in and attachment of the risers and any subsequent changeout of the risers;

the vessel being able to abandon the mooring by activating the QDC and then releasing the flotation canister with the RHU still locked into it and the buoyancy of the flotation canister being such as to ensure that the head of the canister and the RHU remain above water level all abandonment functions being controlled remotely from the bridge of the vessel without any requirement for crew members to be present on or near the devices comprising the invention or the focsle area as a whole;

the mooring swivel incorporating a rotational indexing motor or device to enable the inner part of the mooring swivel together with the QDC assembly and the inner part of the multiple path swivel stack to be rotated to the appropriate geodetic azimuth for recovery of the canister and RHU regardless of the azimuth of the vessel;

a pair of winches being mounted in the cylindrical space between the upper part of the QDC and the swivel stack with the winch lines running down through the QDC for attachment to the head of the RHU on the floating canister (by crew standing on the structure hanging from the inner ring of the mooring swivel) as the vessel approaches for pickup and reconnection so that the canister can then be pulled towards the vessel and the vessel towards the canister with the gimbal automatically coming into appropriate alignment for mating and latching;

the hydraulic supply to the QDC and to the latches in the LC being routed from the vessel via fluid path swivels in the swivel stack and the locks and hydraulic circuitry and controls being designed so as to provide appropriate functional interlocks and fail-safe behaviour.

In a further aspect of the present invention, there is provided a connector assembly as defined in the attached claims. Further features of the connector assembly are defined above.

Embodiments of the present invention will now be described, by way of example only, with reference to the accompanying drawings, in which.

Figure 1:
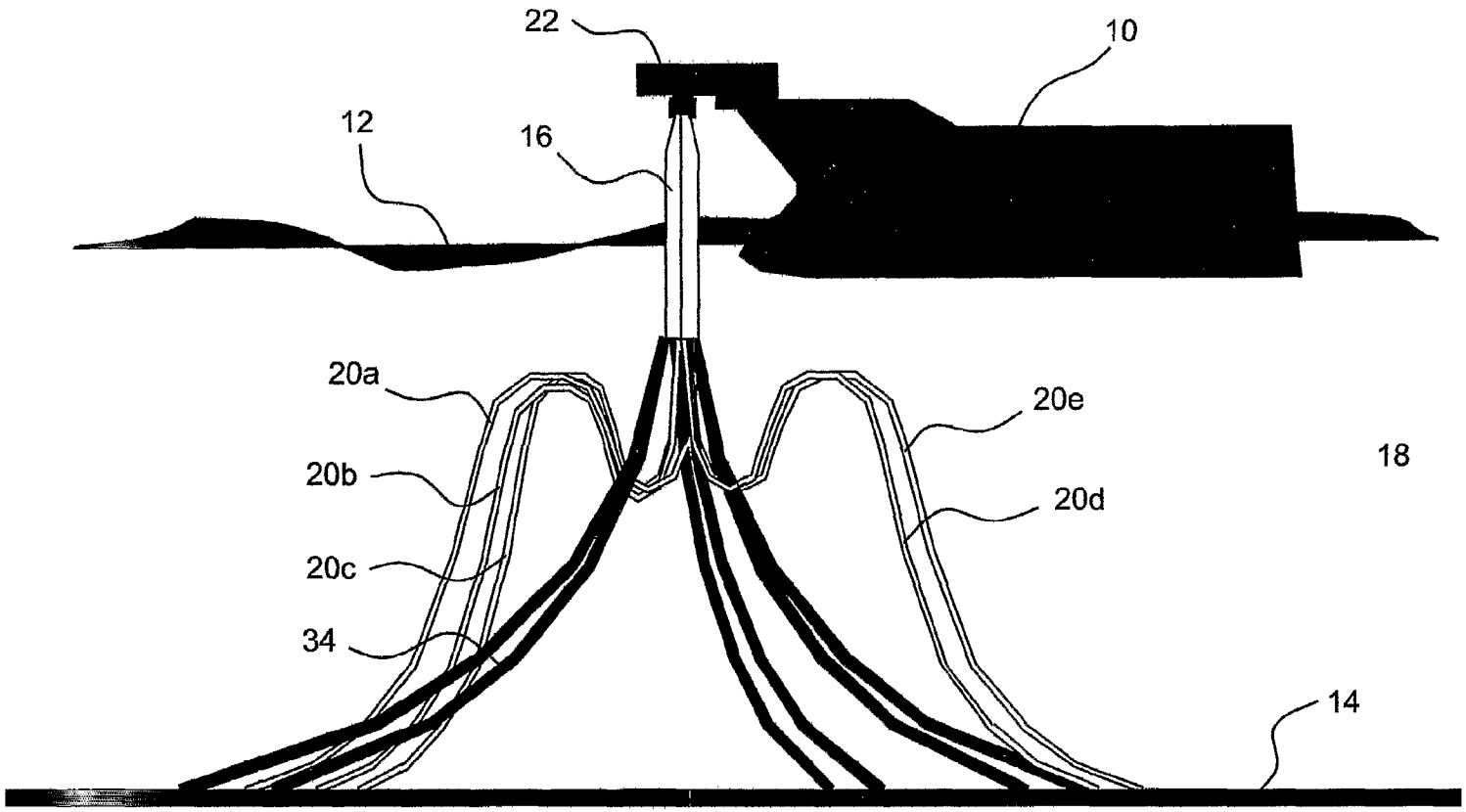
FIG. 1 is a schematic side view of a vessel shown moored to an offshore mooring and riser inboarding system in accordance with a preferred embodiment of the present invention.

Turning firstly to FIG. 1, there is shown a schematic side view of a vessel 10, the vessel 10 shown moored to an offshore mooring and riser inboarding system in accordance with a preferred embodiment of the present invention, the system indicated generally by reference numeral 12. The system 12 is shown in more detail in the enlarged, perspective view of FIG. 2 and in FIG. 3, which is an enlarged, partial cross-sectional view of part of the system 12 shown in FIG. 1.

Figure 4:
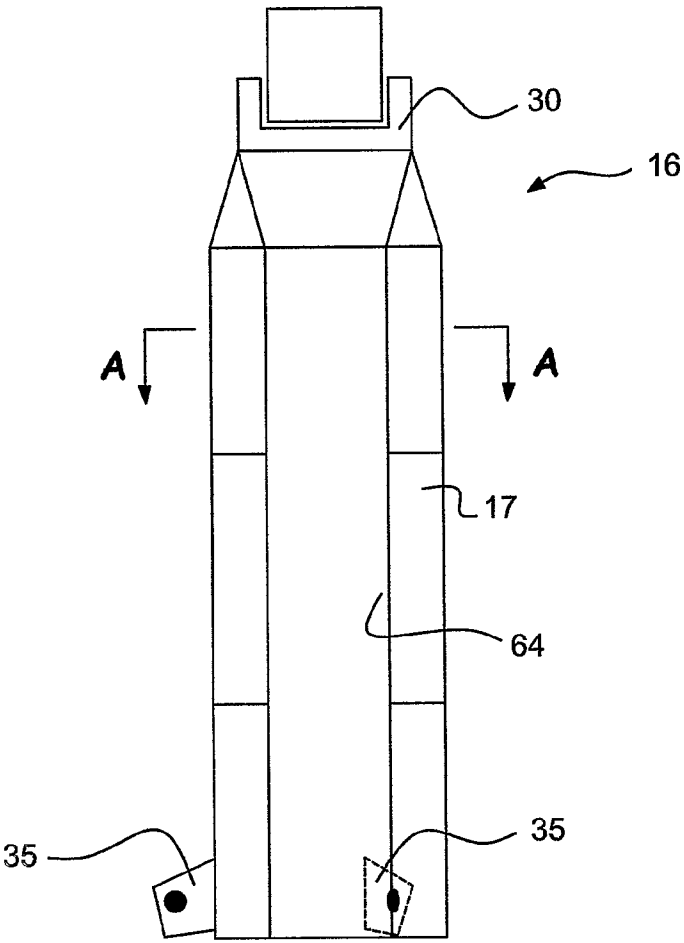
FIG. 4 is a view of the complete first mooring element of the system shown in FIG. 1.
Figure 5:
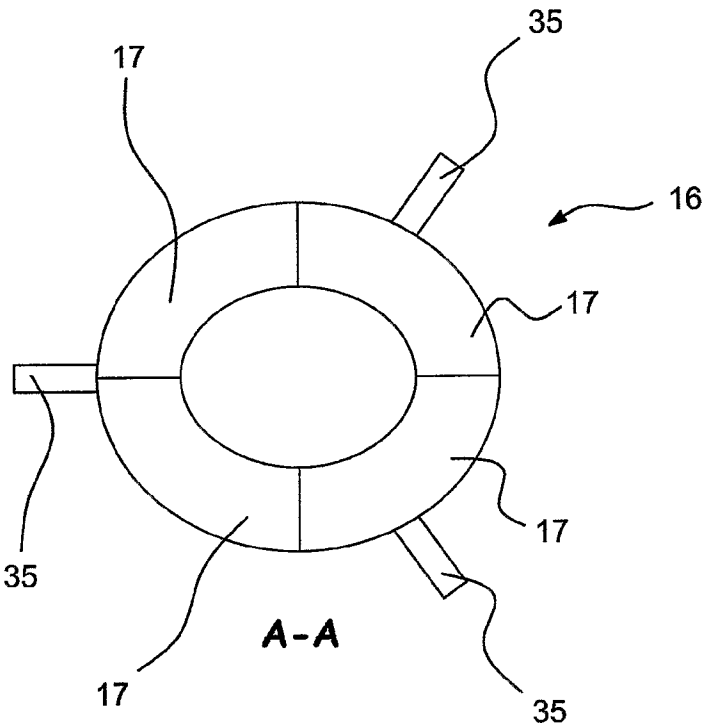
FIG. 5 is a cross-sectional view of the first mooring element taking about the line A-A of FIG. 4.

The vessel 10 may take the form of an FPSO, FSO, an off-take tanker or a buffer tanker, and is shown in the figures moored to a seabed 14 by the system 12, for the transfer of well fluids such as oil or gas to the vessel 10. The system 12 comprises a first mooring element in the form of a flotation canister 16, which is shown separately in FIG. 4 and in the cross-sectional view of FIG. 5, which is taken about line A-A of FIG. 4. As shown in FIG. 1, the flotation canister 16 is located in an offshore environment 18, such as a sea or ocean. The system 12 also comprises at least one and, in the illustrated, preferred embodiment, a number of risers, five of which are shown in FIG. 1 and given the reference numerals 20*a* to 20*e*. The risers 20*a* to 20*e* take the form of fluid flow risers or flowlines and extend from the seabed 14 into the flotation canister 16. The inherent buoyancy of the main fluid flowlines 20*a* to 20*e* is utilised to arrange the lines in a "lazy wave" configuration, which reduces loading on the flowlines and allows for movement of the flotation canister 16 without transferring excessive loading on to the flow lines 20*a* to 20*e*. However, the canister 16 includes buoyancy chambers 17 and is thus inherently buoyant, to support the risers 20. It will be understood that any other alternative configuration of the flowlines 20*a* to 20*e* may be employed. Each of the main fluid flowlines 20*a* to 20*e* extend from a respective subsea wellhead (not shown) or pumping facility provided on the seabed 14 (not shown), for supplying well fluids through the respective main flowline 20 to the vessel 10.

Figure 2:
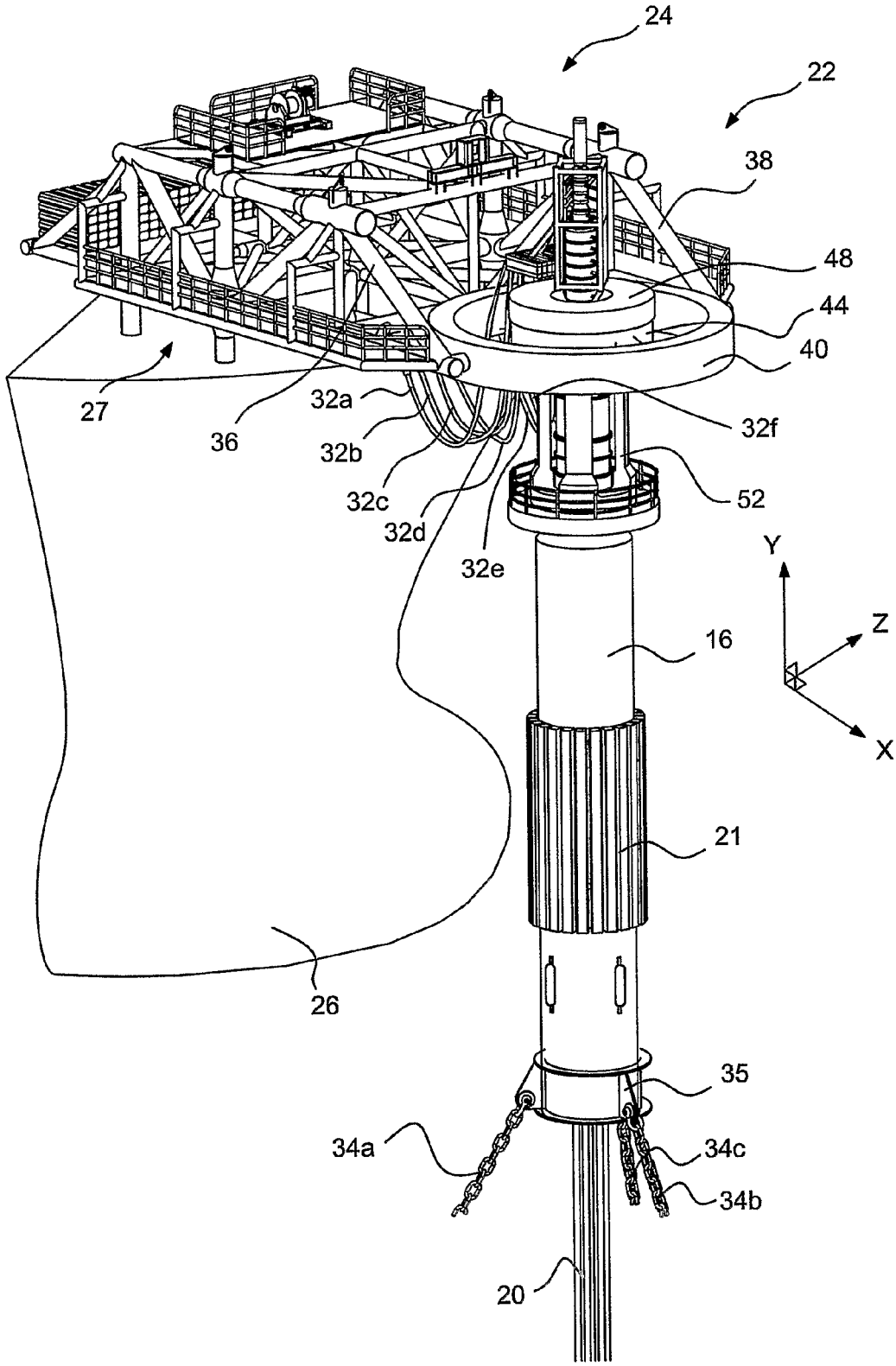
FIG. 2 is an enlarged, perspective view of the system and a bow of the vessel shown in FIG. 1.

The system also comprises a connector assembly 22 which includes a support in the form of a frame 24 which is mounted on a bow 26 of the vessel 10 on the forecastle 27 as best shown in FIG. 2. The connector assembly includes a second mooring element of the system 12, which is indicated generally by reference numeral 28. The second mooring element 28 forms a second connector for coupling to a first connector defined by a neck 30 of the flotation canister 16.

The system 12 also comprises at least one and, in the illustrated, preferred embodiment, a number of transfer lines, six of which are shown and given the reference numerals 32*a* to 32*e*, each of which corresponds to a respective riser 20. The transfer flowlines are provided as catenary jumpers 32*a* to 32*e*, and are each coupled between the vessel 10 and the second connector 28, and serve for transfer of fluid through the respective riser 20 to the vessel 10 when the second connector 28 is coupled to the flotation canister 16, as will be described in more detail below.

The flotation canister 16 is moored in the offshore environment 18 by a number of mooring lines 34, which are coupled to padeyes on the canister 16. As shown in FIG. 2, there may be three such mooring lines 34*a* to 34*c* and the mooring lines may be catenary chains, cables, wires or a combination thereof. As will be understood by persons skilled in the art, selection of the appropriate mooring line 34 depends upon factors including water depth in the offshore environment 18. In the illustrated embodiment, however, catenary chains 34*a* to 34*c* are employed, which are anchored to the seabed 14 and serve for maintaining position of the flotation canister 16 within accepted tolerances, and for supporting loading transmitted to the canister 16 by the vessel 10, in use.

As will be described in more detail below, the connector assembly 22 permits a relative rotation between the vessel 10 and the flotation canister 16 about three mutually perpendicular axes of rotation X, Y and Z, as shown in FIG. 2. The axes X and Z are in a horizontal plane and are perpendicular to one another. The Y axis is in a vertical plane and is perpendicular to both the X and Z axes. In a neutral position of the system 12, where the flotation canister 16 is vertically oriented and assuming no external loading on the vessel 10, the X axis is parallel to a main, longitudinal or sagittal axis of the vessel 10; the Y axis is parallel to a main, longitudinal axis of the flotation canister 16; and the Z axis is parallel to a transom or transverse plane of the vessel 10.

Figure 6:
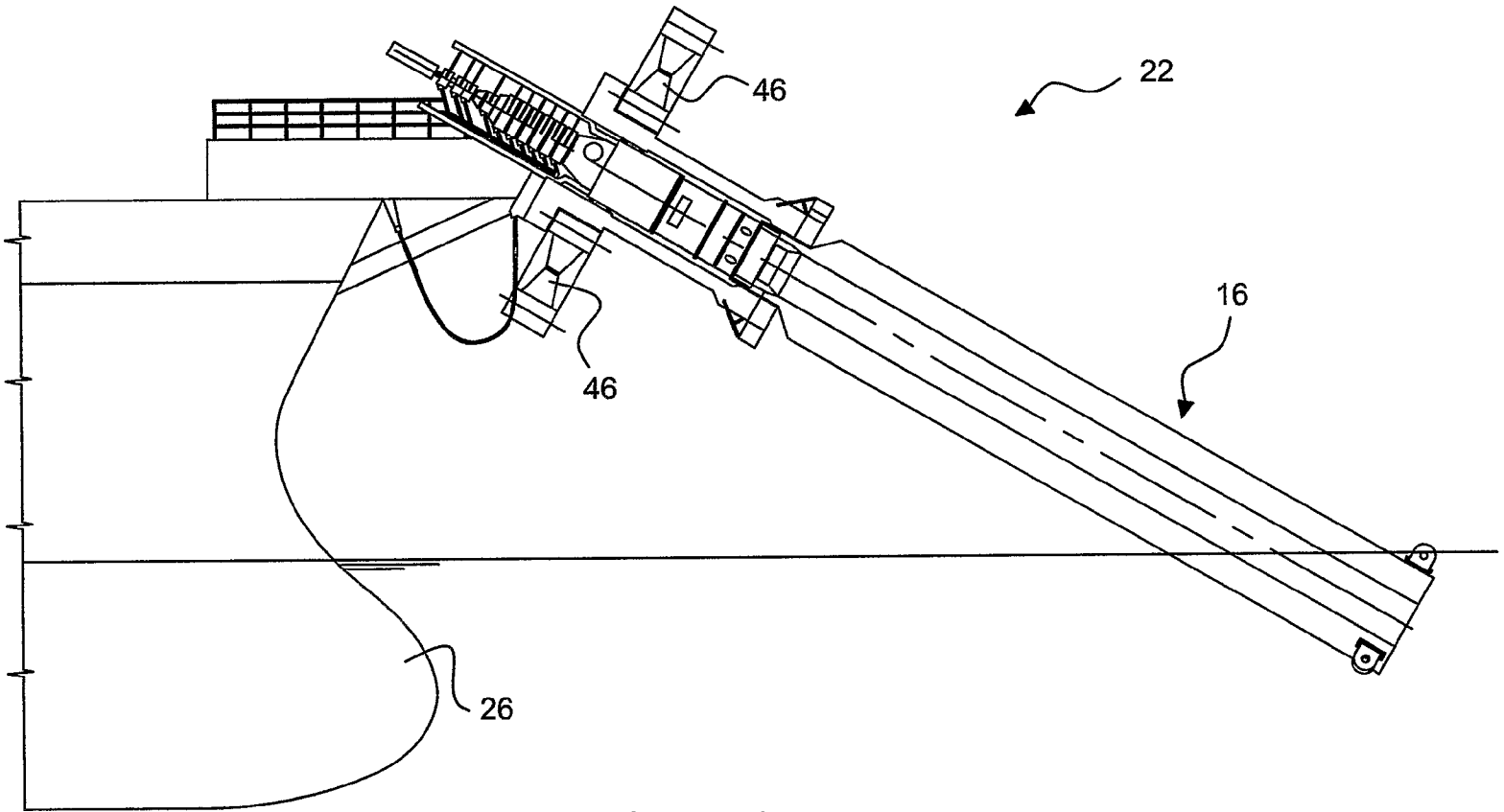
FIG. 6 is an enlarged view of part of the system shown in FIG. 1, taken from the other side, and illustrated when the vessel experiences a large surge force in an astern direction.
Figure 7:
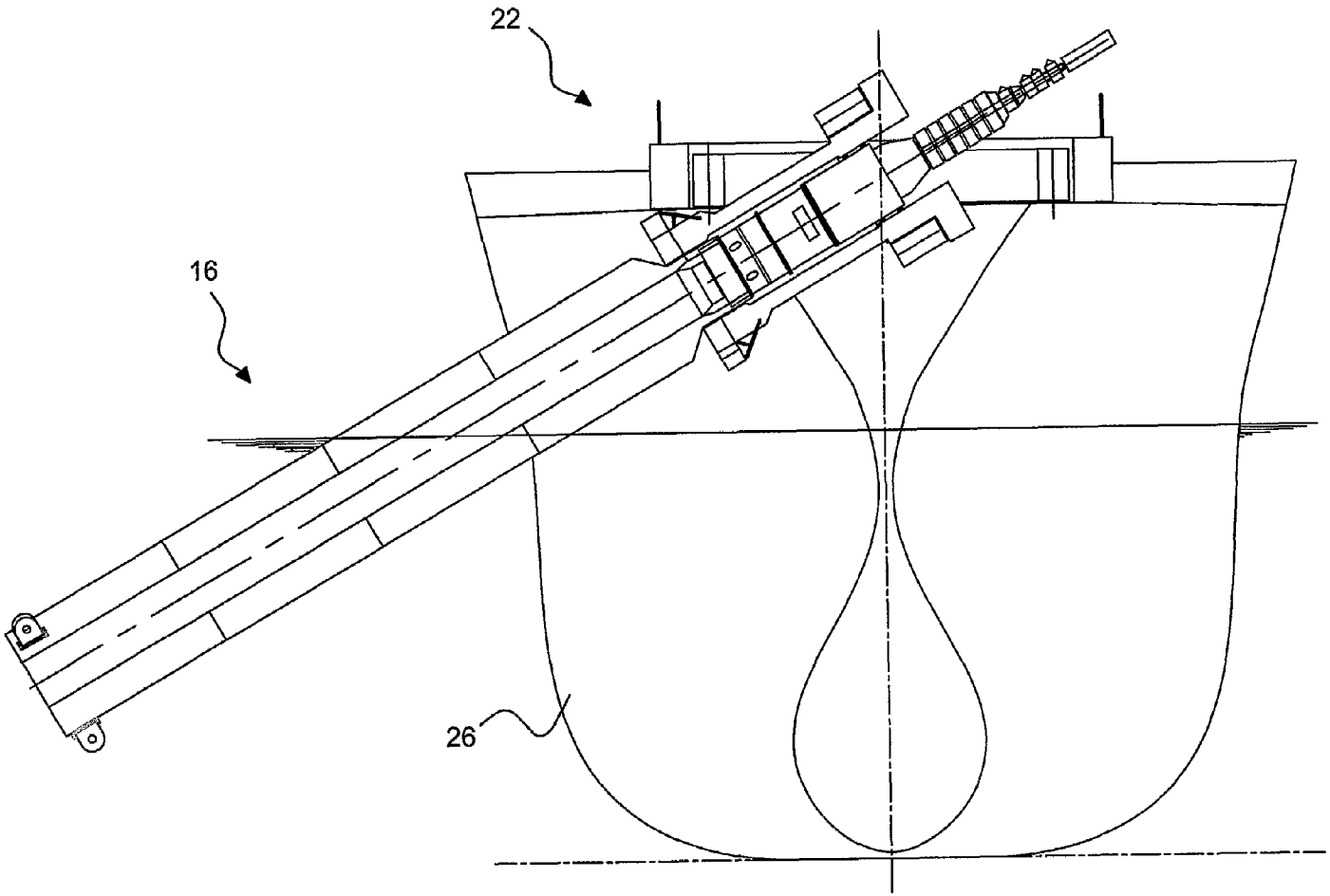
FIG. 7 is an enlarged front view of part of the system shown in FIG. 1, illustrated when the vessel experiences a large force in a thwartship direction.

By this arrangement, the vessel 10 may weathervane according to the prevailing wind, wave and/or tide where the vessel is turned to face the direction of applied loading, by rotation about the Y axis. Additionally, the connector assembly 22 permits an angular deviation between the vessel 10 and the flotation canister 16 of up to 60 degrees astern and 15 degrees forward from the neutral position of FIG. 2 about the Z axis, as shown in FIG. 6, which is an enlarged view of the system 12 shown when the vessel 10 experiences a large surge force in an astern direction. It will be noted that certain components of the system 12 have been omitted from FIG. 6, for ease of illustration. Relative rotation between the vessel 10 and the flotation canister 16 about the X axis is shown in FIG. 7, where the vessel 10 is experiencing a large thwartship force derived from the combination of, for example, low frequency yaw and sway and wave frequency roll. The relative dimensions of the system 12 and in particular of the connector assembly 22 are such that unlimited rotation of the vessel 10 in a path around a circumference of the flotation canister 16 is possible (about the Y axis). Additionally, these dimensions are such that an angular misalignment of up to 60 degrees from the vertical is possible in any other direction, as shown in FIGS. 6 and 7, subject only to the constraint of avoiding interference with the bulbous bow. Thus a total relative movement of up to about 75 degrees about the Z axis is possible (60 degrees during surge astern and about 15 degrees during surge forward) and of up to 120 degrees about the X axis. The canister 16 includes bumper strips 21 which prevent damage to the canister through accidental contact with the vessel bow 26.

The system 12 therefore facilitates vessel mooring and riser inboarding even where the vessel experiences extremes of loading due to wind, wave and/or tidal forces.

The structure and method of operation of the system 12 will now be described in more detail, with reference also to FIGS. 8 to 17.

Figure 3:
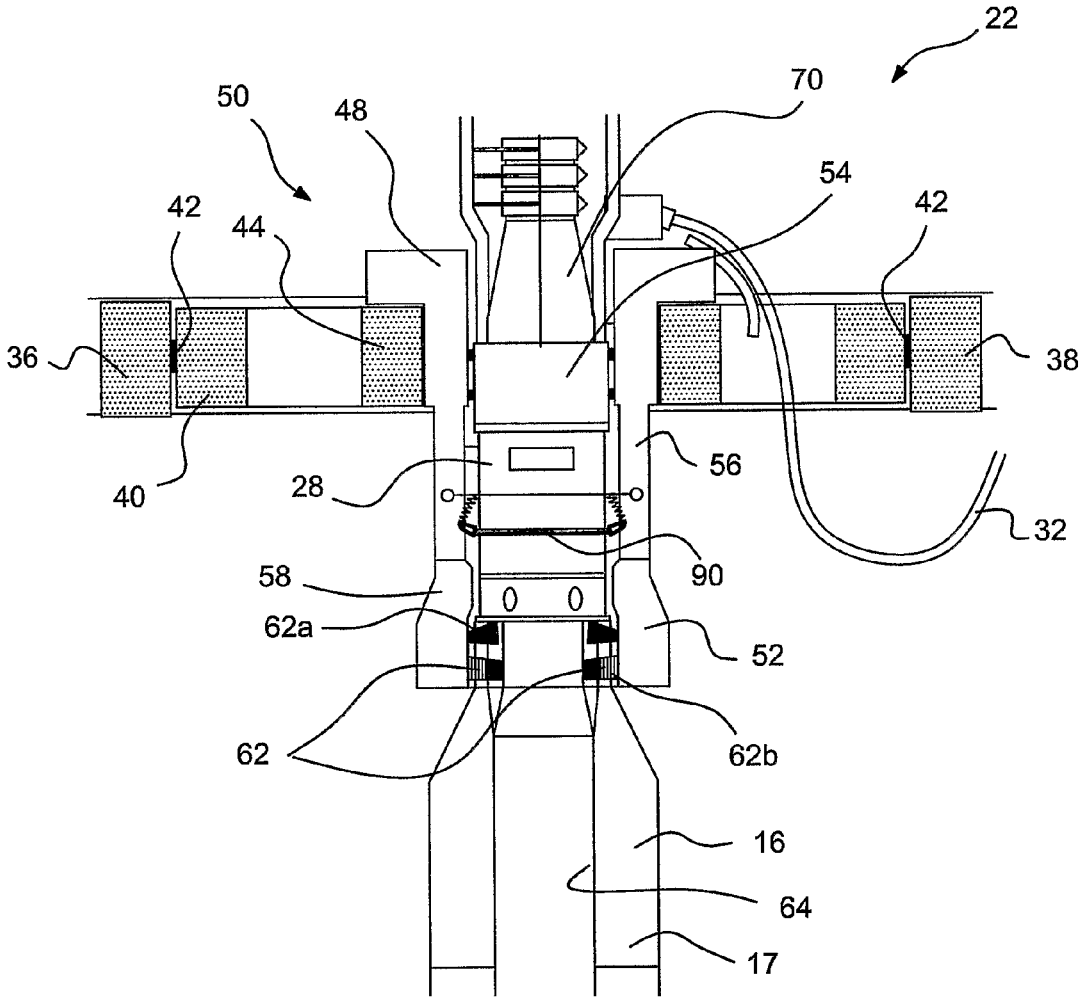
FIG. 3 is an enlarged, partial cross-sectional view of part of a first mooring element, and part of a connector assembly comprising a second mooring element, of the system shown in FIG. 1.

As best shown in FIGS. 2 and 3, the support frame 24 includes outer support arms 36 and 38 by which the second connector 28 is suspended from the vessel 10. The connector assembly 22 includes an outer gimbal member in the form of an outer gimbal ring 40, which is rotatably mounted between the outer support arms 36 and 38 by trunnions 42. The connector assembly 22 also includes an inner gimbal member in the form of an inner gimbal ring 44, which is rotatably mounted to the outer gimbal ring 40 by trunnions 46, which are best shown in FIG. 6. The trunnions 42 and 46 are disposed on axes which are perpendicular to one another, such that respective axes of rotation of the outer and inner gimbal rings 40 and 44 are also perpendicular.

An inner flanged swivel ring 48 is mounted and suspended from the inner gimbal ring 44, and the inner gimbal ring 44 and inner swivel ring 48 together define a swivel 50. This facilitates rotation between the inner gimbal ring 44 and the inner swivel ring 48, via suitable bearings (not shown). An integral structure in the form of a lower housing 52 is coupled to and extends downwardly from the inner swivel ring 48, and the second connector 28 is coupled to the inner swivel ring 48 and extends along the lower housing 52 and is thus suspended from the inner gimbal ring 44.

The outer gimbal ring 40 facilitates angular displacement between the vessel 10 and the flotation canister 16 in the fore and aft directions, as illustrated in FIG. 6, by rotation about the outer support arms 36 and 38 on the trunnions 42. In a similar fashion, the inner gimbal ring 44 permits annular displacement between the vessel 10 and the flotation canister 16 in the thwartship direction of FIG. 7, by rotation of the inner gimbal ring 44 relative to the outer gimbal ring 40 on the trunnions 46.

Figure 8:
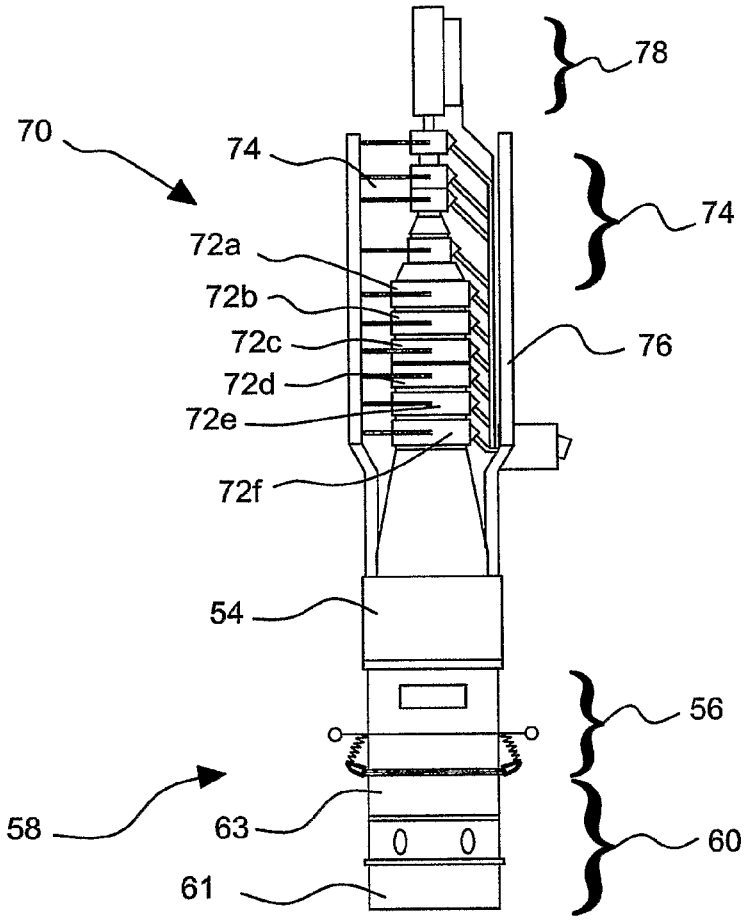
FIG. 8 is an enlarged view of part of a locking assembly and a riser take-off unit of the system shown in FIG. 1.

The second connector 28 includes a housing 54 which is located within and secured relative to the inner swivel ring 48. The second connector 28 includes a locking mechanism 56 which forms an upper part of a quick disconnect (QDC) 58, which is also shown in FIG. 8. A lower part 63 of the QDC 58 forms part of a riser hang off unit (RHU) 60, which also includes a latching can 61 that is secured to the canister neck 30 by latches 62*a*. The RHU 60 supports the risers 20, which extend upwardly through a central shaft 64 of the canister 16, and includes a latching can. The RHU 60 is normally permanently latched into the head or neck 30 of the canister 16 and constitutes an integral part of the canister.

Figure 9:
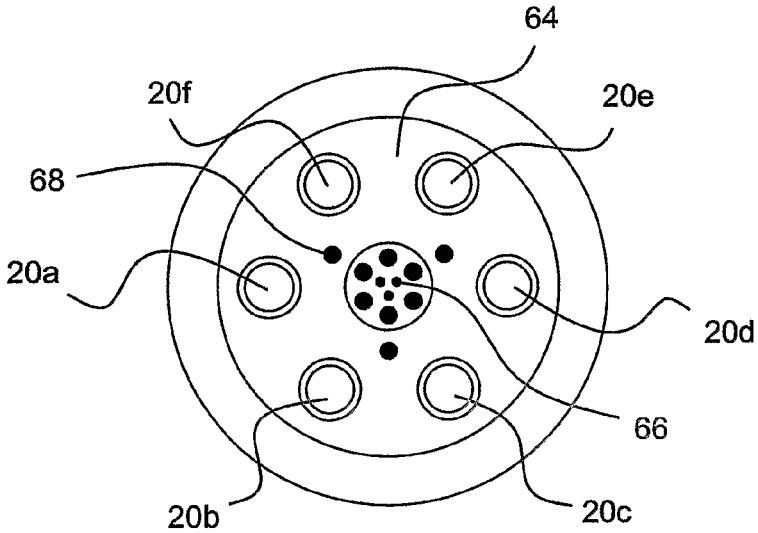
FIG. 9 is a schematic cross-sectional view of the first mooring element of the system shown in FIG. 1, taken at a location where it abuts a riser hang-off of the system.

FIG. 9 illustrates flow risers 20*a* to 20*f* in cross-section at the interface between the canister 16 and the QDC 58. FIG. 9 also illustrates hydraulic and electrical umbilical cores 66 and shows QDC valve and latch actuator hydraulic cores 68, which are used to control operation of the QDC 58.

As shown in FIG. 8, the housing 54 of the second connector 28 carries a multiple path swivel stack 70, which includes a number of primary fluid swivels 72*a* to 72*f*, each associated with a respective riser 20 and jumper 32. The primary fluid swivels 72 provide fluid connection between a riser 20 and the respective jumper 32, and facilitates unlimited rotation of the vessel 10 about the canister 16 whilst maintaining fluid flow. Connectors may extend between the swivels 72 and the risers 20. A secondary swivel assembly 74 is provided above or below the primary fluid swivels 72, and provides for canister to mooring swivel latch actuation; QDC valve actuation; QDC release actuation; umbilical hydraulic line connection; hydraulic core 68 connection; and connection to other ancillary equipment. An optional methanol line 76 and electrical slipring box 78, for handling the umbilical power and signal cores 68, is also shown in FIG. 8. The housing 54 contains piping extending from the QDC 58 to the swivel stack 70 and pull-in winches (not shown), which are used during connection, as will be described below.

Figure 10:
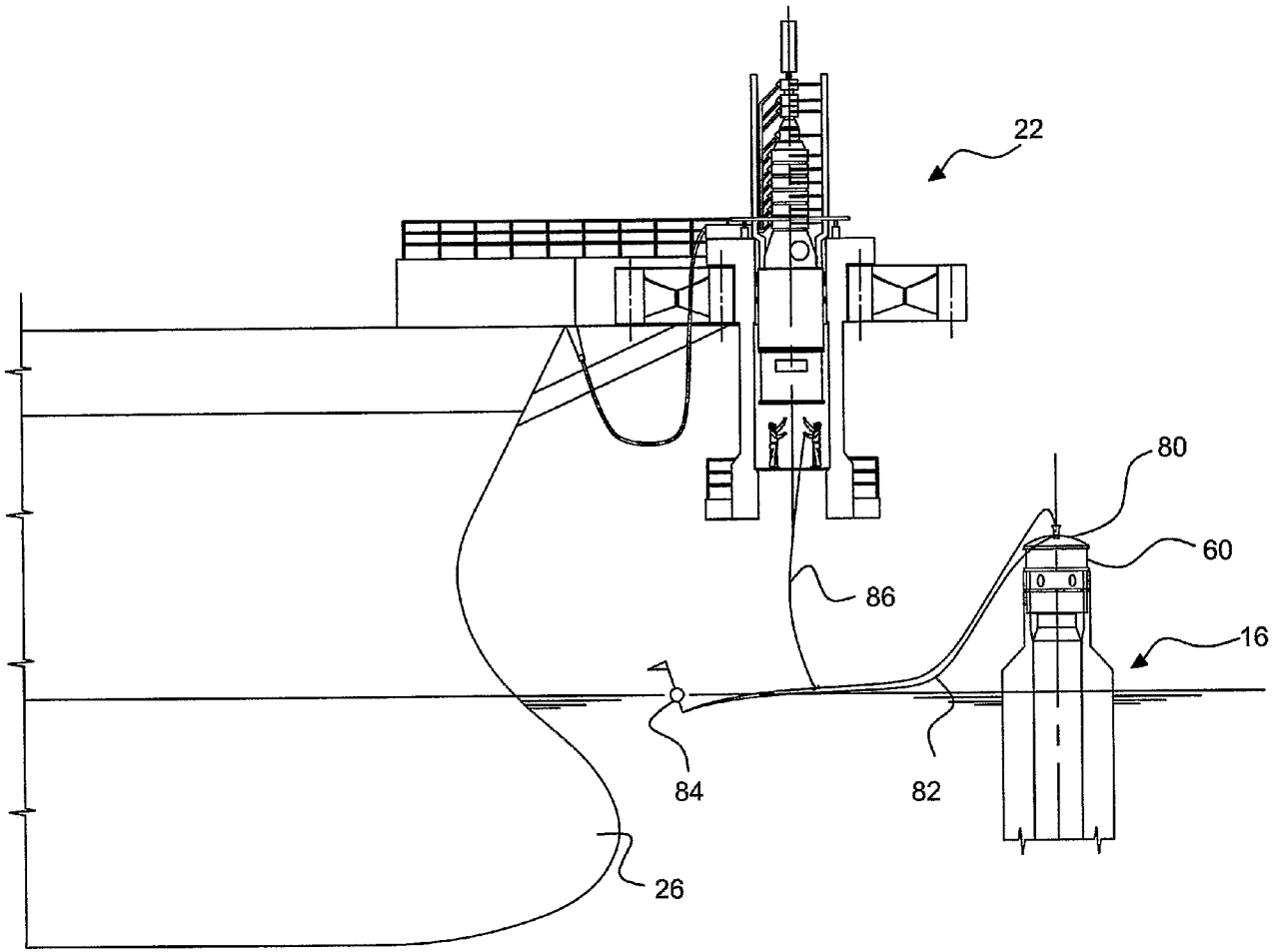
FIGS. 10 to 13 are views illustrating the steps in a method of connecting the first and second mooring elements of the system shown in FIG. 1 together.
Figure 11:
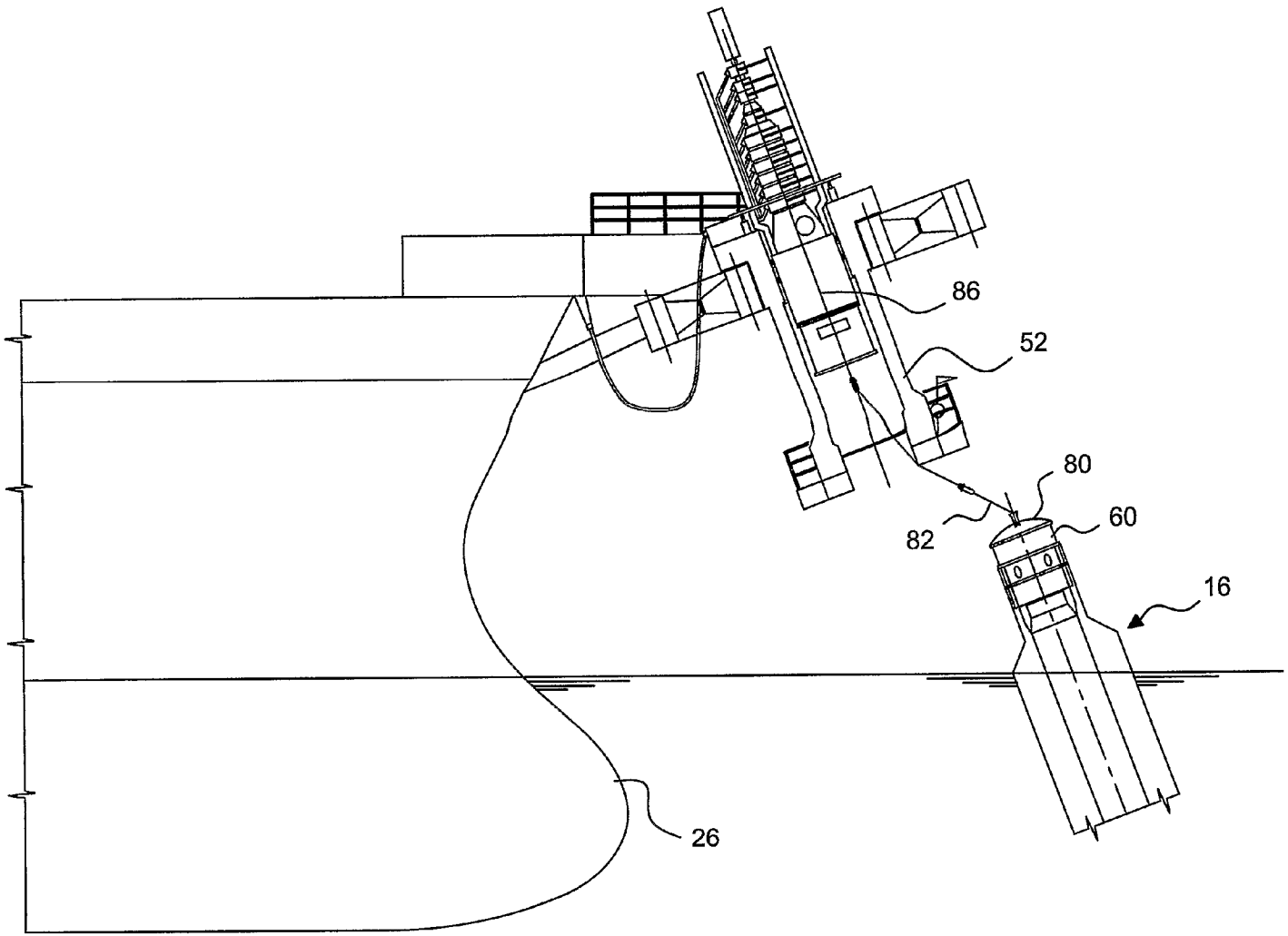

Turning now to FIGS. 10 to 13, the method of connection of the second connector 28 to the flotation canister 16 will now be described. In FIG. 10, the vessel 10 is shown approaching the canister 16, which is shown with the RHU 60 latched to the canister neck 30 by latches 62*b*. A protective cover 80 is also shown in place on the RHU 60. A connector line 82 is coupled to the cap 80 and is marked by a buoy 84. When it is desired to mate the second connector 28 with the flotation canister 16, a winch line 86 is hooked on to the connector line 82, as shown in FIG. 10. The connector line 82 is then reeled-in, as shown in FIG. 11, and bears against a lower end of the lower housing 52, rotating the connector assembly 22 about the support arms 36 and 38 by the outer gimbal ring 40. Automatic alignment of the swivel 50 and the canister head of the RHU 60 is assured during pull-in by the two angular degrees of freedom of the gimbals 40, 44 and two degrees of freedom of the canister 16.

When the canister 16 is picked up, it is important that the azimuth of the riser array and lower part of the QDC assembly 58 around the central axis of the stack match with the azimuth of riser connections on the underside of the upper part of the QDC assembly 58. Final adjustment can be achieved with the aid of simple mechanical guides(not shown), but the azimuths must first be brought into approximate alignment using an indexing system (not shown). This is done by fitting a gear ring in the around the stack at a convenient level, such as in the swivel 50, with an associated hydraulic motor and gearbox. An operator with a remote (wandering lead) control box stands in a position where he can observe the RHU 60 and canister 16 approaching and turns the stack so as to match the azimuths of the upper and lower parts.

Figure 12:
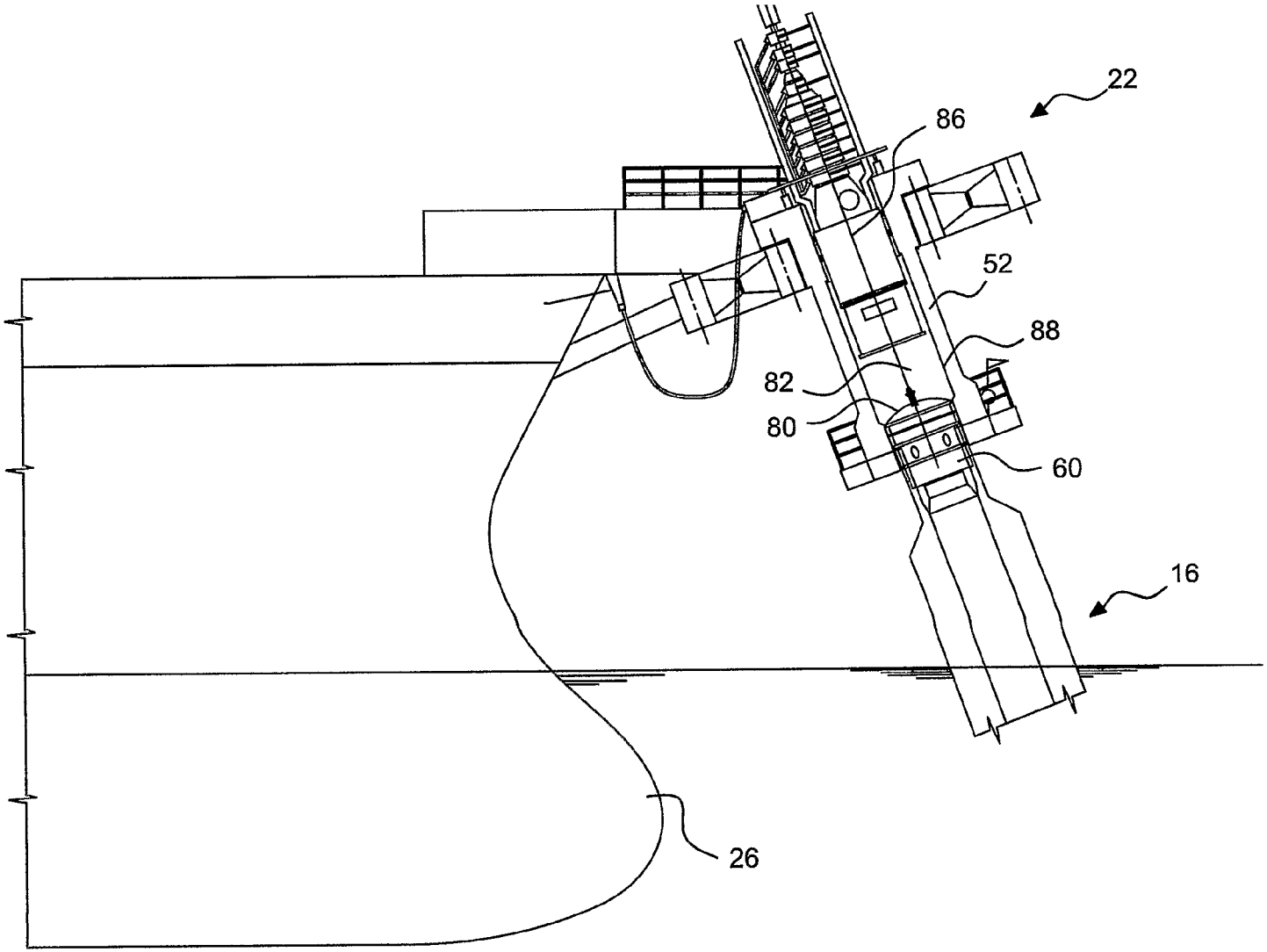
Figure 13:
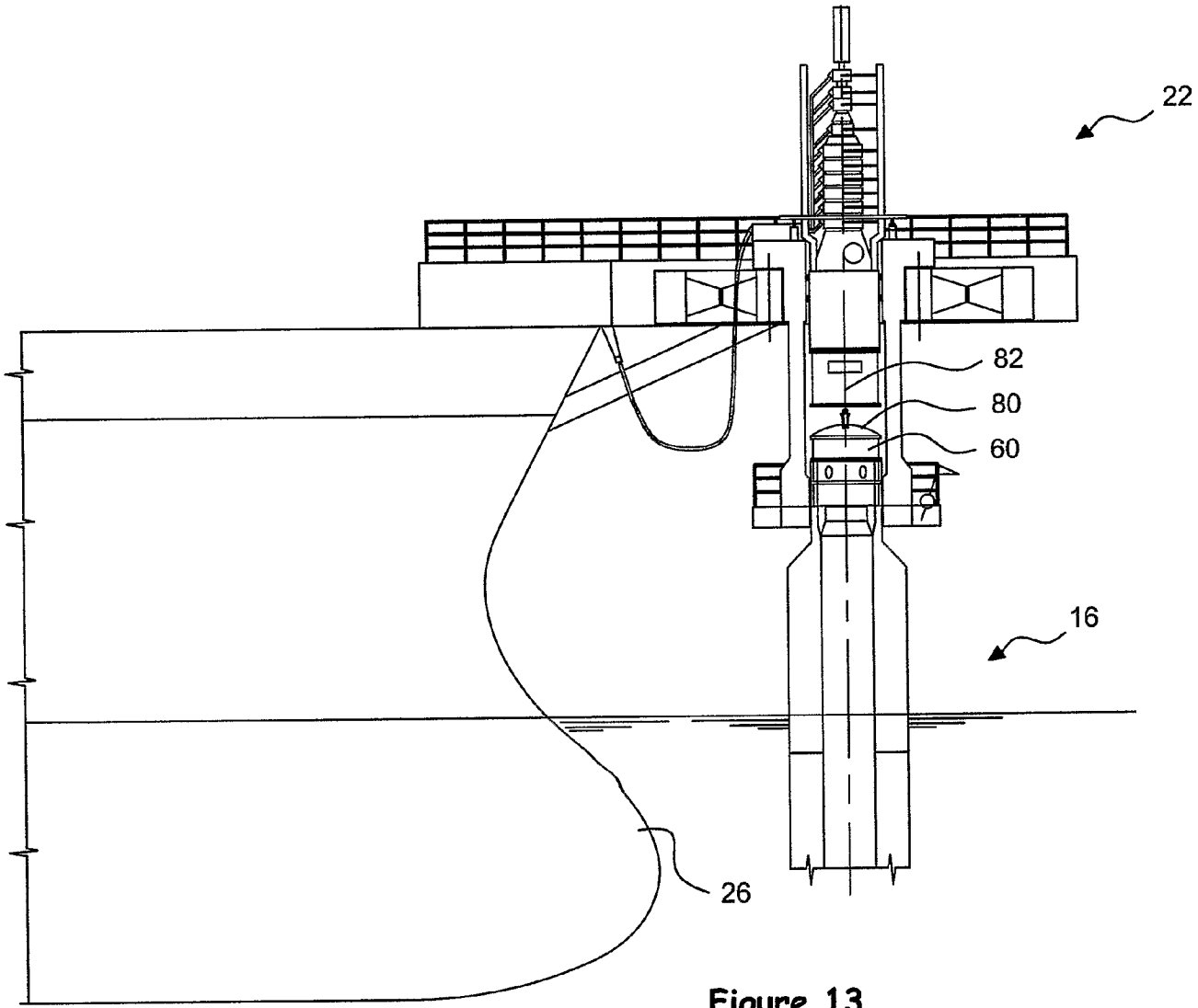

Accordingly, the second connector 28 is rotated to align it with the RHU 60, by rotating the swivel 50 the indexing system. Further reeling-in then draws the RHU 60 into an internal passage 88 defined by the lower housing 52, as shown in FIG. 12, and the vessel 10 is then moved forwards to position on station with the canister 16 in a vertical orientation, as shown in FIG. 13. The canister 16 is supported and the cap 80 removed, following which the canister 16 is drawn up and the locking mechanism 56 is operated to engage an upper ring 90 of the RHU, as shown in FIG. 3. The lower latches 62*a* are also actuated to engage the lower housing 52, and the canister 16 is locked and supported 16 within the housing 28 and is ready for operation.

Figure 14:
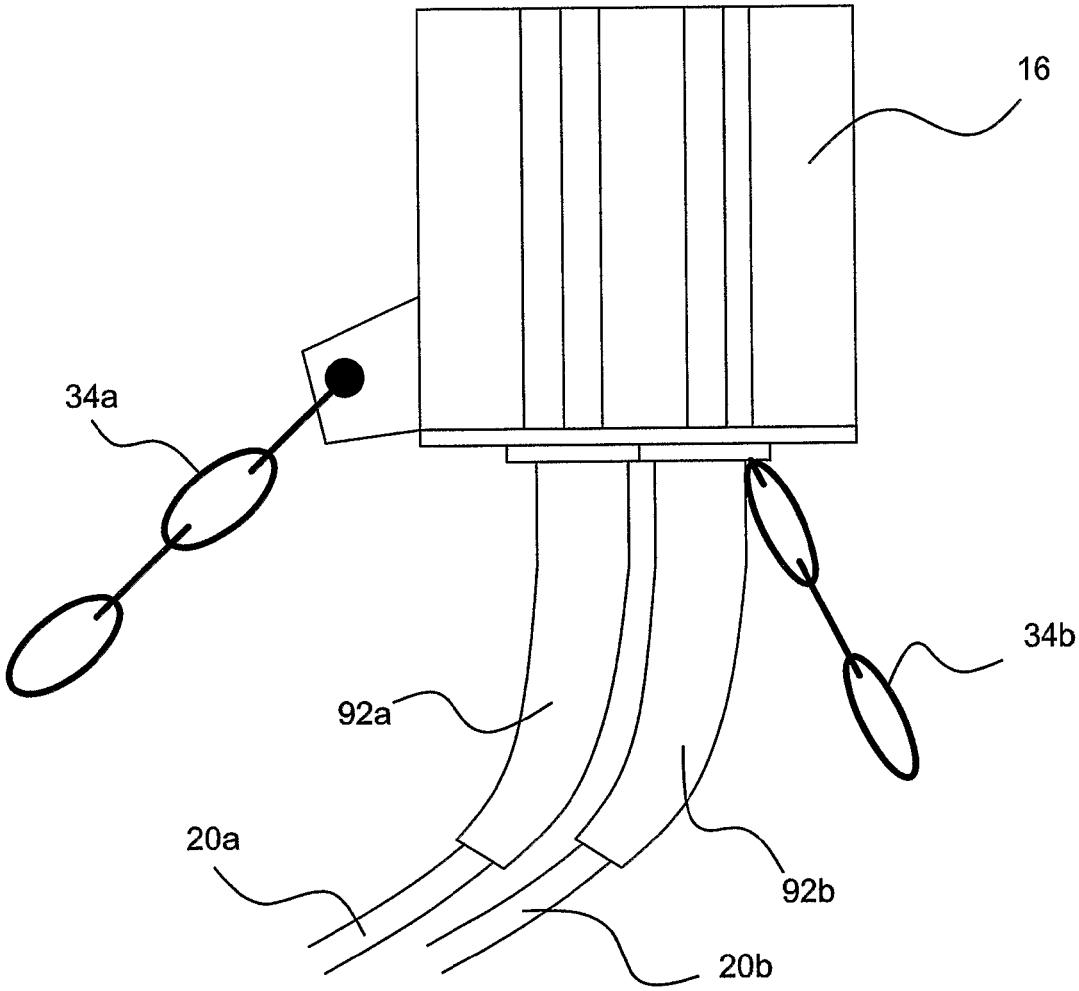
FIG. 14 is an enlarged view of a bottom part of the first mooring element shown in FIG. 4.

Following connection and appropriate testing of integrity of the system 12, fluid communication between the risers 20 and the vessel 10, through the primary fluid swivels 72 and jumpers 32, may commence. The outer gimbal ring 40, inner gimbal ring 44 and swivel 50 permit a full range of motion of the vessel under wind, wave and tidal loading, including any combination of pitch, heave, roll, surge, sway and yaw and also weathervaning (a particular manifestation of yaw), without requiring disconnect from the flotation canister 16. Movement of the canister 16 under load, as illustrated for example in FIGS. 6 and 7, causes a degree of flexing in the risers 20 where they enter the canister 16. Accordingly, as shown in FIG. 14, which is an enlarged view of a lower part of the flotation canister 16, bend stiffeners 92 are provided around the risers 20; two such bend stiffeners 92*a* and 92*b* are shown on the risers 20*a* and 20*b*. These provide protection for the risers 20 against damage through contact with the canister 16.

When it is desired to abandon connection with the flotation canister 16, a controlled abandonment may be carried out in fair weather. This is achieved by releasing the locking mechanism 56 and the latches 62*a* and lowering the canister 16 to the position of FIG. 13. This provides a space 94 facilitating access to re-secure the protective cover 80 and connector line. The RHU 60 is then lowered out of the lower housing 52. The connector line 86 can then be disconnected and the vessel 10 may move away from the location of the canister 16, for example, for passage to discharge location or if it is desired to abandon the oil/gas field. However, in certain circumstances, such as in an emergency abandonment or in a heavy seaway, no crew are allowed in the vicinity and the RHU 60 may be released without a protective cover.

Figure 15:
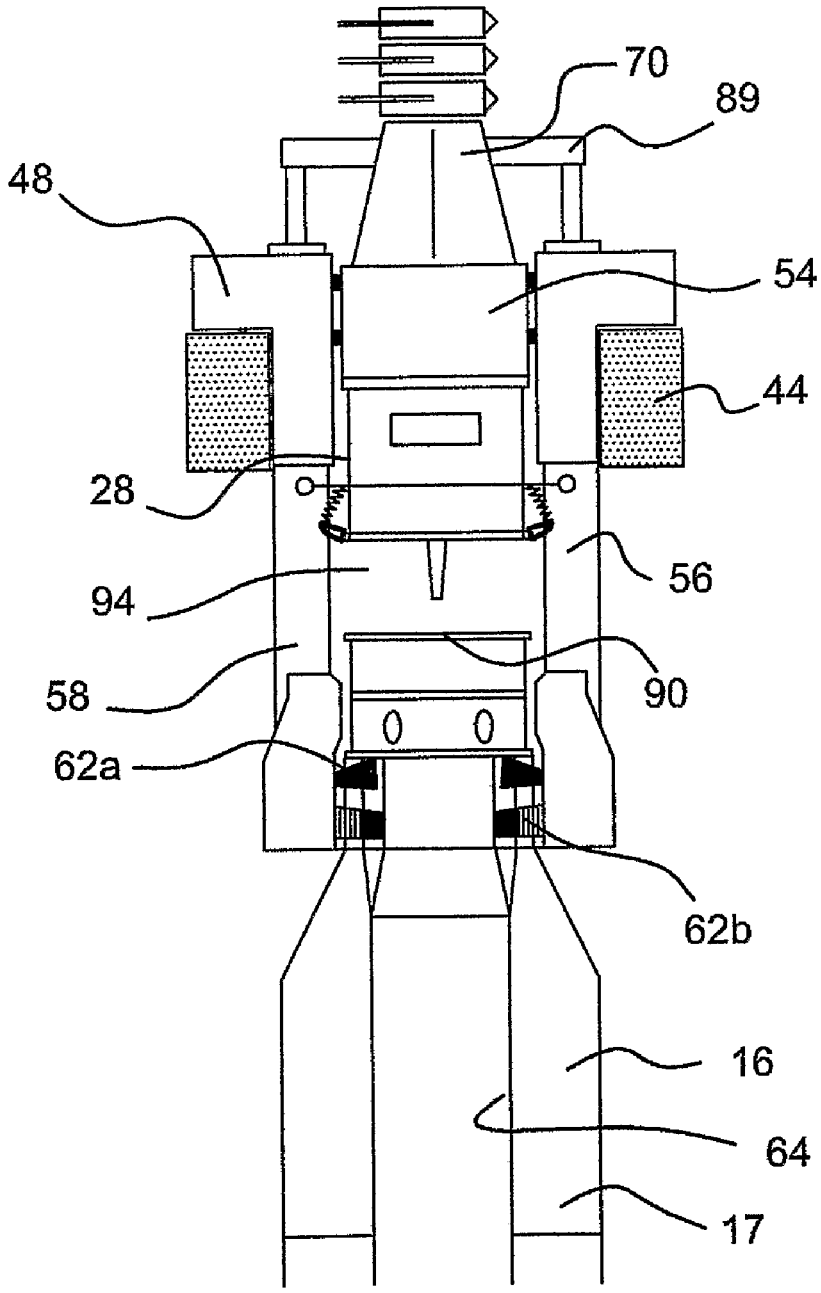
FIG. 15 is a view illustrating part of the system of FIG. 1 during riser installation, changeout, or inspection and maintenance.

FIG. 15 illustrates an optional maintenance procedure, where the locking mechanism 56 is released and a jack assembly 89 actuated. This carries the housing 54 upwardly, to provide a space 94 for access to the RHU 60.

In other circumstances, it may be desired or required to access the RHU 60, to carry out maintenance work, such as on supports for the risers 20 or to carry out riser installation/changeout. To enable this, the latch elements 62*a* are operated to release a lower ring 96 of the RHU 60, and the jack assembly 89 is actuated to carry the second connector housing 54 and the RHU 60 upwardly, to provide a space 98 for access to the inside of the RHU 60 and the risers 20, as shown in FIG. 16.

Figure 16:
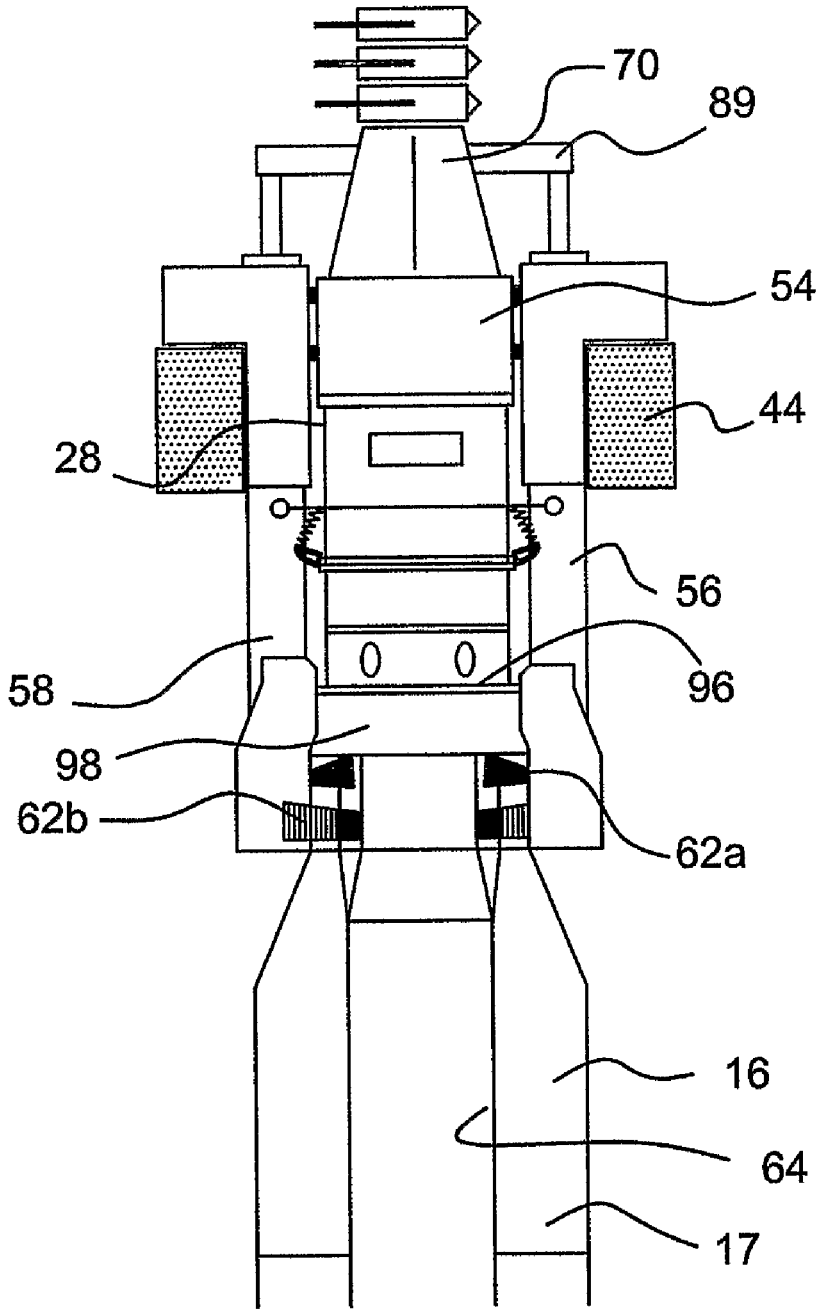
FIG. 16 is a view illustrating part of the system during a maintenance procedure.

Indeed, FIG. 16 also illustrates first connection of the FPSO 10 to the canister 16; the canister 16 (without the RHU 60) and its moorings 34 are installed before the FPSO 10 arrives at the field. The risers 20 are likewise installed before FPSO 10 arrival and are buoyed off. The RHU is installed on the FPSO 10 at the dockyard. The upper part of the RHU 60 is the lower part of the QDC 58 and the QDC 58 is locked in a connected mode. When the FPSO 10 arrives on site, the canister 16 is picked up and latched in, the bottom of the RHU 60 is latched into it, the RHU 60 unbolted at the intermediate level, and the whole stack from this unbolted level upwards is jacked up to give access for riser connection to riser hangoff flanges. A pickup winch line 82 (or the line of a temporary small service crane) is deployed, taken down through the canister 16 core, brought backup to the surface, and connected to the first riser 20*a*, which will have been raised to the surface and disconnected from the temporary buoy. This activity requires the assistance of another vessel; riser installation and replacement are rare events. The assisting vessel then lowers the top of the riser 20*a* until it is below the canister 16 and the weight of the riser 20*a* is transferred to the pull-in line 82. The riser 20*a* is then pulled up and the hangoff flange is bolted up. This requires good access for Hydratight™ bolting equipment and the operators, hence the need to break the RHU 60 and jack it apart. This process is repeated for each of the risers 20.

Figure 17:
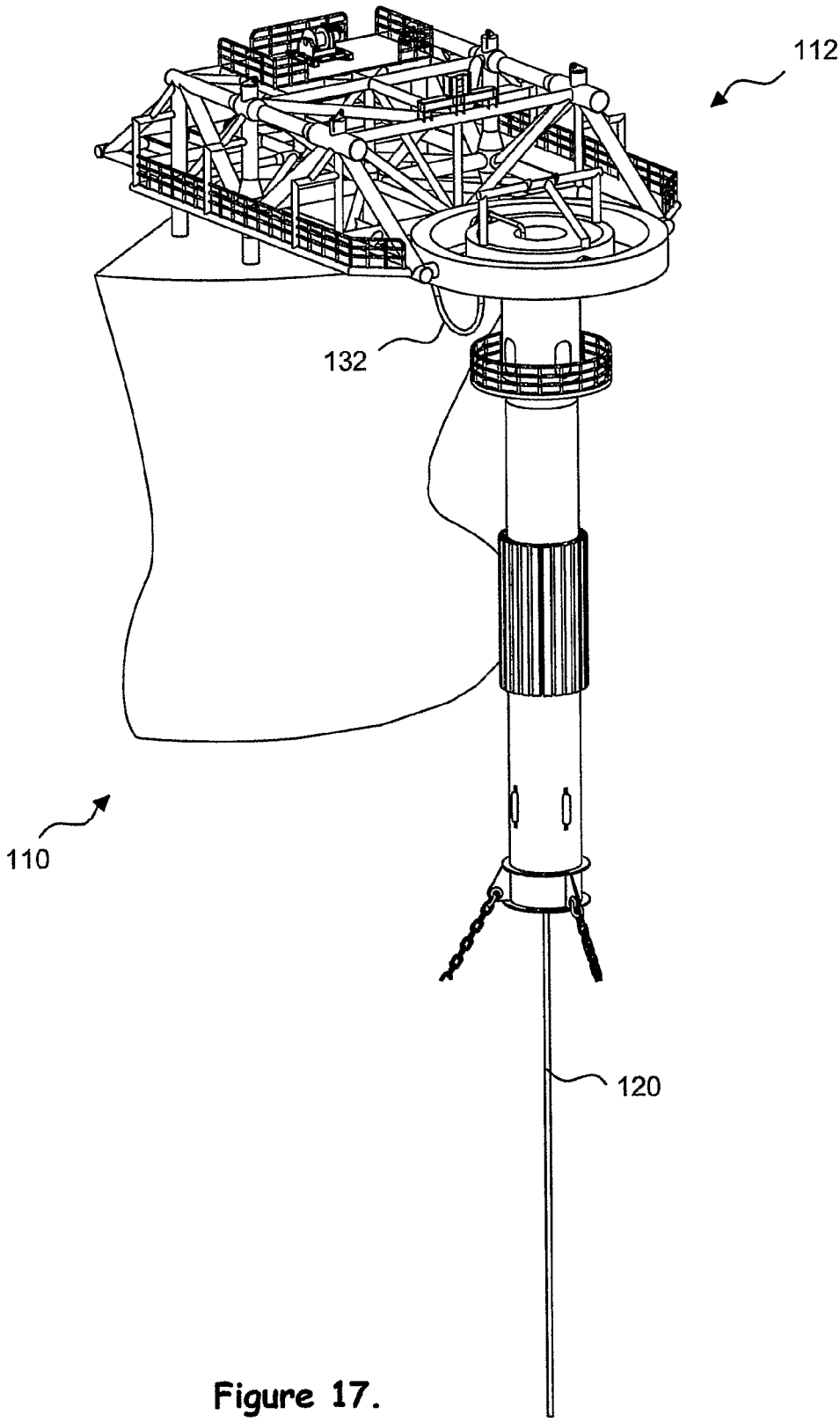
FIG. 17 is a perspective view of a vessel shown moored to an offshore mooring and flowline system in accordance with an alternative embodiment of the present invention.

Turning now to FIG. 17, there is shown a perspective view of a vessel 110 shown moored to an offshore mooring and flowline system in accordance with an alternative embodiment of the present invention, the system indicated generally by reference numeral 112. The system 112 is essentially similar to the system 12 shown in FIGS. 1 to 16, and like components share the same reference numerals incremented by 100. The vessel 110 may be a similar vessel to that described above in relation to FIGS. 1 to 16, but will typically be an FSO. The system 112 differs from the system 12 in that it includes only a single riser 120 and associated jumper 132, and therefore does not require the multiple path swivel stack 70 of the system 12. Additionally, with only a single riser 20, an indexing system may not be required.

Figure 18:
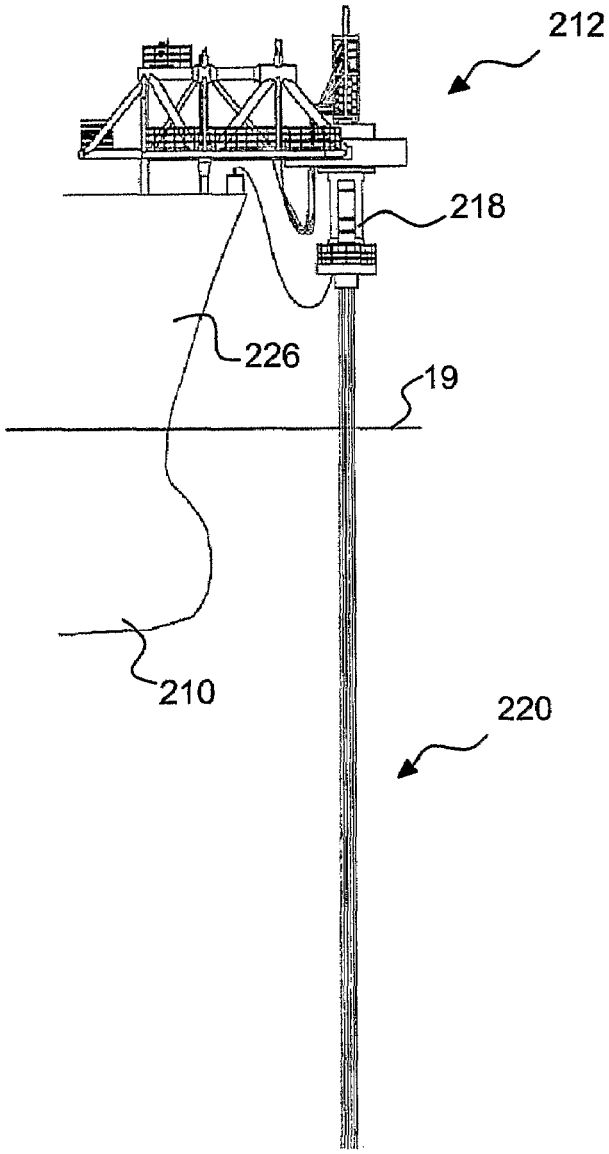
FIG. 18 is a side view of a bow of a vessel shown moored to an offshore mooring and flowline system in accordance with a further alternative embodiment of the present invention.

Turning now to FIG. 18, there is shown a side view of a bow 226 of a vessel 210 shown moored to an offshore mooring and riser inboarding system in accordance with a further alternative embodiment of the present invention, the system indicated generally by reference numeral 212. The system 212 is essentially similar to the system 12 shown in FIGS. 1 to 16, and like components share the same reference numerals incremented by 200. The vessel 210 shown in FIG. 18 is a DP vessel such as an FPSO, and includes thrusters (not shown) for maintaining the vessel in a fixed geographical location. This enables the vessel 210 to remain on station, that is, in the vicinity of a buoy 216 forming a first mooring element of the system 212. As the vessel 210 is dynamically positioned, it is not necessary for the buoy 216 to be moored relative to the seabed 14 by heavy mooring lines such as the catenaries 34; this is because the buoy 216 does not need to transmit loads experienced by the vessel 210 due to the prevailing wind, wave or tide to the seabed 14. Accordingly, risers 220 are able to maintain the buoy 216 approximately on station. However, the indexing system may be utilised to account for friction in a swivel of the system 212; the indexing system may be activated to maintain a rotational position (about the Y axis) of the buoy 216. This ensures that the lower assembly does not turn with the weathervaning FPSO 210, which could result in the risers 220 twisting about each other and the individual risers 220 being subjected to excessive, detrimental twist. The risers 220 are thus maintained on a constant geodetic azimuth. In this situation, the indexing motor will be controlled automatically by a system of gyrocompasses and a computer (not shown), with a manual override for emergency situations.

Figure 19:
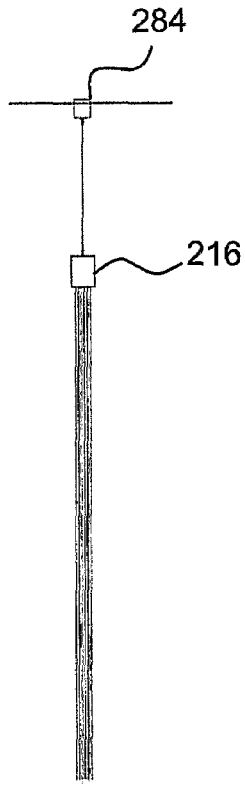
FIG. 19 is a view of the system of FIG. 18 prior to connection of first and second mooring elements of the system together or after disconnection.

As shown in FIG. 19, which is a view prior to connection of a second connector 218 to the buoy 216, the inherent buoyancy of the buoy 216 is such that the buoy is initially below the sea surface 19, and a marker buoy 284 indicates the location of the primary buoy 216. By locating the buoy 216 below the sea surface 19, the buoy is shielded from external loads at surface. The system 212 is otherwise of similar construction and operation to the system 12 of FIGS. 1 to 16.

Figure 20:
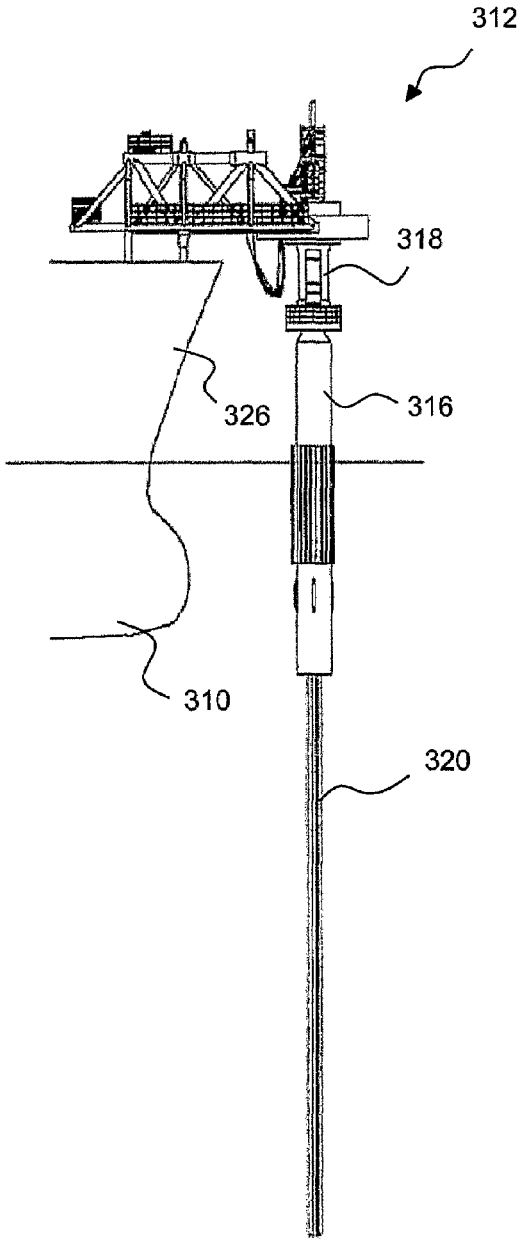
FIG. 20 is a side view of a bow of a vessel shown moored to an offshore mooring and flowline system in accordance with a still further alternative embodiment of the present invention.

Turning now to FIG. 20, there is shown a side view of a bow 326 of a vessel 310 shown moored to an offshore mooring and riser inboarding system in accordance with a still further alternative embodiment of the present invention, the system indicated generally by reference numeral 312. The system 312 is essentially similar to the system 12 shown in FIGS. 1 to 16, and like components share the same reference numerals incremented by 300. However, in a similar fashion to the system 212 of FIGS. 18 and 19, the vessel 310 is a DP vessel. Accordingly, the first mooring element of the system 312, which takes the form of a canister 316 (similar to the canister 16 of the system 12) does not need to be moored relative to the seabed 14 by heavy mooring lines; the risers 320 are able to maintain the canister 316 approximately on station.

Figure 21:
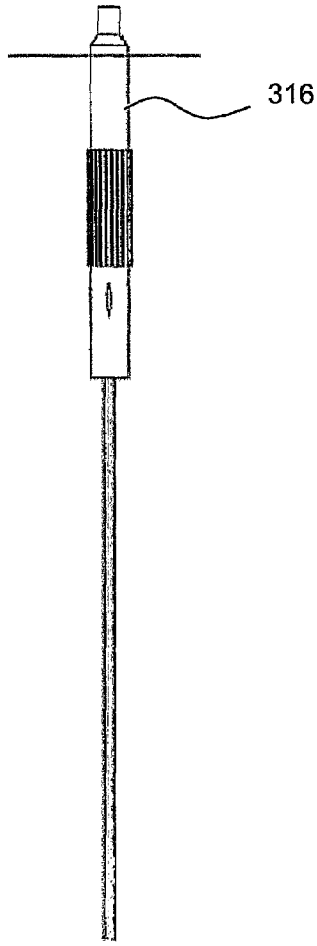
FIG. 21 is a view of the system of FIG. 20 prior to connection of first and second mooring elements of the system together.

As shown in FIG. 21, which is a view prior to connection of a second connector 318 to the canister 316, the inherent buoyancy of the canister 316 is such that the canister is initially at a similar level to the canister 16. However, the canister 316 may be initially below sea surface 19, in a similar fashion to the buoy 216 of the system 212, if desired.

Various modifications may be made to the foregoing without departing from the spirit and the scope of the present invention.

For example, the above described embodiments of the invention include adjustable couplings in the form of inner and outer gimbal members which facilitate relative rotation between the vessel and the first mooring element about two axes of rotation. However, the system may include any suitable, alternative adjustable couplings in place of the gimbals.

The system may comprise any suitable riser found in the offshore environment, used in the oil and gas exploration and production industry, for bringing the riser onboard or inboard to a vessel.

In the embodiments of the invention where a DP vessel is moored using the system, the vessel may weathervane around the first mooring element, rotating about a vertical or Y axis, with little or minimal rotation about the other axes of rotation. By allowing the vessel to weathervane, loads on the vessel may be reduced.

The first and second mooring elements may be coupled together using any, suitable alternative coupling/locking mechanism.

The invention claimed is:

1. An offshore vessel mooring and riser inboarding system, the system comprising:

a first mooring element located in an offshore environment and coupled to a fluid flow riser, the mooring element defining an internal passage for receiving the riser;

a connector assembly comprising:

a cantilever support mounted on a vessel;

a second mooring element suspended from the cantilever support and which can be connected to the first mooring element, to thereby suspend the first mooring element from the cantilever support;

an outer gimbal member mounted for rotation relative to the cantilever support;

an inner gimbal member mounted within and for rotation relative to the outer gimbal member; and a rotatable coupling for facilitating rotation of the inner gimbal member relative to the first mooring element;

a transfer flowline adapted to be coupled to the fluid flow riser; and a swivel, the transfer flowline coupled to the fluid flow riser through the swivel;

wherein, in use:

the first and second mooring elements are connected to facilitate coupling of the fluid flow riser and the transfer flowline;

the outer gimbal member, the inner gimbal member and the rotatable coupling together permit relative rotation between the vessel and the first mooring element about three mutually perpendicular axes of rotation;

the fluid flow riser ascends through the internal passage in the first mooring element, through the rotatable coupling and the inner and outer gimbal members to the swivel; and the rotatable coupling and the swivel facilitate unlimited rotation of the vessel about a longitudinal axis of the first mooring element while maintaining fluid flow.

2. A system as claimed in claim 1, wherein the three mutually perpendicular axes of rotation are taken with reference to the first mooring element in a neutral position.

3. A system as claimed in claim 1, wherein the riser is a conduit for hydrocarbon containing fluids.

4. A system as claimed in claim 1, comprising at least one further riser, wherein the further riser is a power cable or a control cable.

5. A system as claimed in claim 1, comprising at least one further riser, wherein the further riser is an electrical cable or a hydraulic cable.

6. A system as claimed in claim 1, comprising at least one further riser, wherein the further riser is an umbilical.

7. A system as claimed in claim 1, wherein connection of the first and second mooring elements facilitates flow of fluid between the fluid flow riser, the transfer flowline and the vessel.

8. A system as claimed in claim 7, wherein the transfer flowline is for the passage of fluid from the fluid flow riser into the transfer flowline and to the vessel, or vice-versa.

9. A system as claimed claim 4, comprising a transfer line which provides an electrical and hydraulic connection to the riser.

10. A system as claimed in claim 9, wherein the transfer line facilitates power supply, data transmission and supply of hydraulic control fluid.

11. A system as claimed in claim 1, wherein the second mooring element is adapted to be mounted for movement relative to the cantilever support.

12. A system as claimed in claim 11, wherein the support is located extending beyond a bow of the vessel.

13. A system as claimed in claim 1, wherein the inner gimbal member is rotatable about an inner gimbal axis and the outer gimbal member about an outer gimbal axis.

14. A system as claimed in claim 13, wherein the inner and outer gimbal member axes are disposed substantially perpendicular to one another.

15. A system as claimed in claim 1, wherein the rotatable coupling facilitates rotation between the inner gimbal member and the second mooring element, to thereby permit relative rotation between the vessel and the first mooring element about one of the three axes of rotation.

16. A system as claimed in claim 15, wherein the rotatable coupling is provided between the inner gimbal member and the second mooring element.

17. A system as claimed in claim 1, wherein the rotatable coupling facilitates rotation between the second mooring element and the first mooring element, thereby permitting relative rotation between the vessel and the first mooring element about one of the three axes of rotation.

18. A system as claimed in claim 17, wherein the rotatable coupling is provided between the first and second mooring elements.

19. A system as claimed in claim 1, wherein the rotatable coupling is a swivel.

20. A system as claimed in claim 1, wherein the inner and outer gimbal members are annular rings.

21. A system as claimed in claim 1, wherein the inner gimbal member is mounted to the outer gimbal member by inner trunnions, and wherein the outer gimbal member is mounted to the cantilever support by outer trunnions, the trunnions of the inner gimbal member disposed perpendicular to those of the outer gimbal member.

22. A system as claimed in claim 1, wherein the connector assembly is releasably mountable on the vessel.

23. A system as claimed in claim 1, wherein the first mooring element is buoyant.

24. A system as claimed in claim 1, wherein the system comprises a buoyant member, and wherein the first mooring element is indirectly coupled to the buoyant member.

25. A system as claimed in claim 1, wherein the first mooring element is tubular.

26. A system as claimed in claim 1, wherein the first mooring element is adapted to be located at surface prior to connection of the first and second mooring elements together.

27. A system as claimed in claim 1, wherein the entire first mooring element is adapted to be located below sea surface level prior to connection of the first and second mooring elements together.

28. A system as claimed in claim 27, wherein a location of the first mooring element prior to connection is indicated by a marker buoy.

29. A system as claimed in claim 24, wherein the buoyant member is adapted to be located at surface prior to connection of the first and second mooring elements together.

30. A system as claimed in claim 1, wherein the first mooring element is adapted to be moored to a seabed in the offshore environment by a plurality of mooring lines, the mooring lines adapted to bear loading of the vessel on the first mooring element, to maintain the element on station and to minimise transmission of loads to the main flowline.

31. A system as claimed in claim 30, wherein the mooring lines are coupled to a lower portion of the first mooring element.

32. A system as claimed in claim 1, wherein the system is for a dynamically positionable vessel.

33. A system as claimed in claim 1, wherein the first and second mooring elements define respective first and second connector elements.

34. A system as claimed in claim 33, wherein the first and second mooring elements are adapted to be coupled together in a quick-connect and disconnect arrangement.

35. A system as claimed in claim 1, wherein one of the first and second mooring elements comprises a male member and the other a female member, the female member adapted to receive the male member for engagement of the elements.

36. A system as claimed in claim 1, wherein the connector assembly comprises a locking arrangement for locking the first and second mooring elements together.

37. A system as claimed in claim 36, wherein the locking arrangement comprises at least one latch adapted to provide a releasable locking engagement between the first and second mooring elements.

38. A system as claimed in claim 1, wherein the connector assembly comprises an intermediate connector for coupling the first and second mooring elements together.

39. A system as claimed in claim 38, wherein the intermediate connector is secured to the first mooring element and thus provided as part of the first mooring element, and is adapted to be releasably coupled to the second mooring element.

40. A system as claimed in claim 39, wherein the intermediate connector is also adapted to be releasably connected to the first mooring element.

41. A system as claimed in claim 38, wherein the intermediate connector is adapted to support the riser, and defines a riser hang-off unit.

42. A system as claimed in claim 41, wherein the connector assembly comprises a jacking device for raising part of the connector assembly to provide access space for connection of the riser to the riser hang-off unit.

43. A system as claimed in claim 1, comprising a plurality of fluid flow risers and a corresponding plurality of transfer flowlines, each transfer flowline associated with a corresponding fluid flow riser.

44. A system as claimed in claim 43, wherein each riser is associated with a separate well, for the flow of well fluids to the vessel.

45. A system as claimed in claim 1, wherein the swivel is coupled to the second mooring element.

46. A system as claimed in claim 1, wherein rotation between the vessel and the first mooring element about at least one of the other two of said axes of up to 60 degrees from a neutral position is permitted, providing up to 120 degrees total permissible rotation.

47. A system as claimed in claim 1, comprising a device for adjusting an orientation of the second mooring element relative to the first mooring element, to facilitate connection of the elements.

48. A system as claimed in claim 47, wherein the connector assembly comprises an indexing device for adjusting a rotational orientation of the first and second mooring elements.

49. A system as claimed in claim 48, wherein the device is for adjusting at least one of a rotational position of the outer gimbal member relative to the support; and of the inner gimbal member relative to the outer gimbal member.

50. A connector assembly for an offshore vessel mooring and riser inboarding system of a type comprising: a first mooring element located in an offshore environment and coupled to a fluid flow riser, the first mooring element defining an internal passage for receiving the riser; and a transfer flowline adapted to be coupled to the fluid flow riser;

the connector assembly comprising:

a cantilever support which can be mounted on a vessel;

a second mooring element suspended from the cantilever support and which can be connected to the first mooring element, to thereby facilitate coupling of the riser and the transfer line and suspension of the first mooring element from the cantilever support;

an outer gimbal member mounted for rotation relative to the cantilever support;

an inner gimbal member mounted within and for rotation relative to the outer gimbal member;

a rotatable coupling for facilitating rotation of the inner gimbal member relative to the first mooring element; and a swivel through which the transfer flowline can be coupled to the fluid flow riser;

wherein, in use:

the first and second mooring elements are connected to facilitate coupling of the fluid flow riser and the transfer flowline;

the outer gimbal member, the inner gimbal member and the rotatable coupling together permit relative rotation between the vessel and the first mooring element about three mutually perpendicular axes of rotation;

the fluid flow riser ascends through the internal passage in the first mooring element, through the rotatable coupling and the inner and outer gimbal members to the swivel; and the rotatable coupling and the swivel facilitate unlimited rotation of the vessel about a longitudinal axis of the first mooring element while maintaining fluid flow.

51. A method of mooring a vessel in an offshore environment, the method comprising the steps of:

locating a first mooring element in an offshore environment;

coupling a fluid flow riser to the first mooring element;

suspending a second mooring element of a connector assembly from a cantilever support mounted on a vessel;

raising the first mooring element and connecting it to the second mooring element to thereby suspend the first mooring element from the cantilever support, the second mooring element being connected to the first mooring element such that relative rotation between the vessel and the first mooring element about three mutually perpendicular axes of rotation is permitted, said relative rotation being permitted by means of an outer gimbal member mounted for rotation relative to the cantilever support, an inner gimbal member mounted within and for rotation relative to the outer gimbal member, and a rotatable coupling which facilitates rotation of the inner gimbal member relative to the first mooring element;

locating the fluid flow riser such that it ascends through an internal passage in the first mooring element, through the rotatable coupling and the inner and outer gimbal members to a swivel coupled to the second mooring element; and connecting a transfer flowline to the fluid flow riser through the swivel;

wherein the rotatable coupling and the swivel facilitate unlimited rotation of the vessel about a longitudinal axis of the first mooring element while maintaining fluid flow.

52. A method as claimed in claim 51, comprising transferring fluid between the fluid flow riser, the transfer flowline and the vessel.

* * * * *